US011933032B2

(12) United States Patent
Nakatani et al.

(10) Patent No.: US 11,933,032 B2
(45) Date of Patent: Mar. 19, 2024

(54) CHEMICAL FEEDING DEVICE

(71) Applicant: Kobayashi Pharmaceutical Co., Ltd., Osaka (JP)

(72) Inventors: Kouji Nakatani, Osaka (JP); Kaoru Kasakawa, Osaka (JP)

(73) Assignee: Kobayashi Pharmaceutical Co., Ltd., Osaka (JP)

( * ) Notice: Subject to any disclaimer, the term of this patent is extended or adjusted under 35 U.S.C. 154(b) by 14 days.

(21) Appl. No.: 17/936,623

(22) Filed: Sep. 29, 2022

(65) Prior Publication Data

US 2023/0097404 A1 Mar. 30, 2023

Related U.S. Application Data

(63) Continuation of application No. PCT/JP2021/036337, filed on Sep. 30, 2021.

(51) Int. Cl.
*E03D 9/03* (2006.01)

(52) U.S. Cl.
CPC ..... *E03D 9/032* (2013.01); *E03D 9/038* (2013.01)

(58) Field of Classification Search
CPC ..... E03D 9/032; E03D 9/038
USPC ..... 4/223
See application file for complete search history.

(56) References Cited

U.S. PATENT DOCUMENTS 1,260,180 A 3/1918 Gallagher
3,336,603 A 8/1967 Leland
3,913,151 A 10/1975 Keimig
3,999,226 A 12/1976 Wolf
4,670,916 A 6/1987 Bloom
8,015,628 B2 * 9/2011 Campau ..... E03D 9/037 4/227.7
2004/0031091 A1 * 2/2004 Landesberg ..... E03D 9/032 4/231

(Continued)

FOREIGN PATENT DOCUMENTS

EP 1387014 A2 2/2004
EP 1591592 A1 11/2005

(Continued)

OTHER PUBLICATIONS

Extended European Search Report in Counterpart European Patent Application No. 22198562.5 dated Feb. 16, 2023.

(Continued)

*Primary Examiner* — Huyen D Le
(74) *Attorney, Agent, or Firm* — Knobbe, Martens, Olson & Bear LLP

(57) ABSTRACT

A chemical feeding device according to the present invention is for attaching to a water tank of a toilet having a tank main body that has an opening in an upper portion and a lid body that covers the opening of the tank main body, the chemical feeding device including a chemical container storing a chemical solution, a flexible tube through which the chemical solution in the chemical container is fed to the water tank, and an attachment member that supports the tube and is configured to be attachable to an edge of the upper opening of the tank main body. The attachment member includes a receiving part in which a recessed part for receiving the chemical solution that drips from the chemical container is formed. In a bottom portion of the recessed part is formed a discharge hole to which the tube is connected.

7 Claims, 25 Drawing Sheets

(56) References Cited

U.S. PATENT DOCUMENTS

| | | | | |
|---|---|---|---|---|
| 2007/0136937 | A1 | 6/2007 | Sawalski et al. | |
| 2009/0178188 | A1 | 7/2009 | Campau et al. | |
| 2011/0296598 | A1* | 12/2011 | Frey | E03D 9/038 4/223 |
| 2012/0266920 | A1* | 10/2012 | Burt | E03D 9/032 4/224 |
| 2016/0024773 | A1* | 1/2016 | Page | A47K 17/00 4/231 |

FOREIGN PATENT DOCUMENTS

| | | | |
|---|---|---|---|
| GB | 2139661 | A | 11/1984 |
| JP | 58-080483 | U1 | 5/1983 |
| JP | 61-207732 | A | 9/1986 |
| JP | 2011-510193 | A | 3/2011 |
| JP | 2013-79496 | A | 5/2013 |
| JP | 2016-124596 | A | 7/2016 |
| JP | 2017-218234 | A | 12/2017 |
| WO | WO 01/88286 | A1 | 11/2001 |
| WO | WO 2007/075819 | A2 | 7/2007 |
| WO | WO 2009/091566 | A1 | 7/2009 |

OTHER PUBLICATIONS

International Search Report in PCT/JP2021/036337 dated Dec. 14, 2021.

Written Opinion of the International Search Authority in PCT/JP2021/036337 dated Dec. 14, 2021.

* cited by examiner

CHEMICAL FEEDING DEVICE

TECHNICAL FIELD

The present invention relates to a chemical feeding device.

BACKGROUND ART

Heretofore, chemical feeding devices that are installed on a water receptacle for washing hands at an upper portion of a water tank of a toilet and feed a chemical solution for cleaning, deodorizing and scenting to flushing water in the water tank are known (e.g., see JP 2013-79496A). Dispensing implements that dispense a gel-like chemical agent onto an inner surface of a toilet bowl and adhere the chemical agent like a stamp are also known (e.g., see JP 2016-124596A and JP 2017-218234A).

JP 2013-79496A, JP 2016-124596A and JP 2017-218234A are examples of related art.

A chemical feeding device such as in JP 2013-79496A cannot be installed if there is no water receptacle for washing hands. Also, even if there is a water receptacle, it will nevertheless not be possible to install a chemical feeding device, in situations such as where an ornament is placed in the water receptacle, for example. On the other hand, when dispensing implements such as in JP 2016-124596A and JP 2017-218234A are used, the amount of chemical agent that can be adhered to the inner surface of the toilet bowl with a single stamp is limited, and there is also a chance that the chemical agent on the inner surface of the toilet bowl will peel off with flushing, preventing the chemical agent from being fed in a stable manner.

An object of the present invention is to provide a chemical feeding device with which an installation location is easily secured and that enables a chemical solution to be fed in a stable manner.

SUMMARY OF THE INVENTION

A first chemical feeding device according to the present invention is a chemical feeding device for attaching to a bowl of a toilet, including a chemical container storing a chemical solution, a flexible tube through which the chemical solution in the chemical container is fed to an inside of the toilet bowl, and an attachment member that supports the tube and is configured to be attachable to a rim of the toilet bowl, the attachment member including a receiving part in which a recessed part for receiving the chemical solution that drips from the chemical container is formed, a discharge hole to which the tube is connected being formed in a bottom portion of the recessed part, and the tube being supported to be located lower than the discharge hole by the attachment member.

In the first chemical feeding device, the attachment member can include an abutting part capable of abutting an outer surface of the rim of the toilet bowl, and a fixing part that, in an initial state, straddles the rim of the toilet bowl from the abutting part and extends downward along an inner wall surface of the toilet bowl.

In the first chemical feeding device, the fixing part is formed with a flexible material and, in the initial state, curves upward in a convex shape.

A second chemical feeding device according to the present invention is a chemical feeding device for attaching to a water tank of a toilet having a tank main body that has an opening in an upper portion and a lid body that covers the opening of the tank main body, including a chemical container storing a chemical solution, a flexible tube through which the chemical solution in the chemical container is fed to the water tank, and an attachment member that supports the tube and is configured to be attachable to an edge of the upper opening of the tank main body, the attachment member including a receiving part in which a recessed part for receiving the chemical solution that drips from the chemical container is formed, a discharge hole to which the tube is connected being formed in a bottom portion of the recessed part, and the tube being supported to be located lower than the discharge hole by the attachment member.

In the second chemical feeding device, the attachment member includes an abutting part capable of abutting an outer surface of the tank main body, and a fixing part that, in an initial state, straddles the edge of the tank main body from the abutting part and extends downward along an inner surface of the tank main body.

In the second chemical feeding device, the fixing part can be formed with a flexible material and, in the initial state, can curve upward in a convey shape.

In the second chemical feeding device, an installation surface on which an edge extending downward from an outer peripheral edge of the lid body is installable can be formed at an upper portion of the abutting part.

According to the present invention, the chemical feeding device has an attachment member configured to be attachable to the rim of a toilet bowl or the edge of the opening of a tank main body, thus enabling the chemical feeding device to be attached to a water tank that is not provided with a water receptacle. Also, the attachment member supports a flexible tube that guides the chemical solution in a chemical container into the toilet bowl or to the water tank, thus enabling the chemical solution in the chemical container to be fed in a stable manner into the toilet bowl or to the water tank.

EMBODIMENTS OF THE INVENTION

Figure 1:
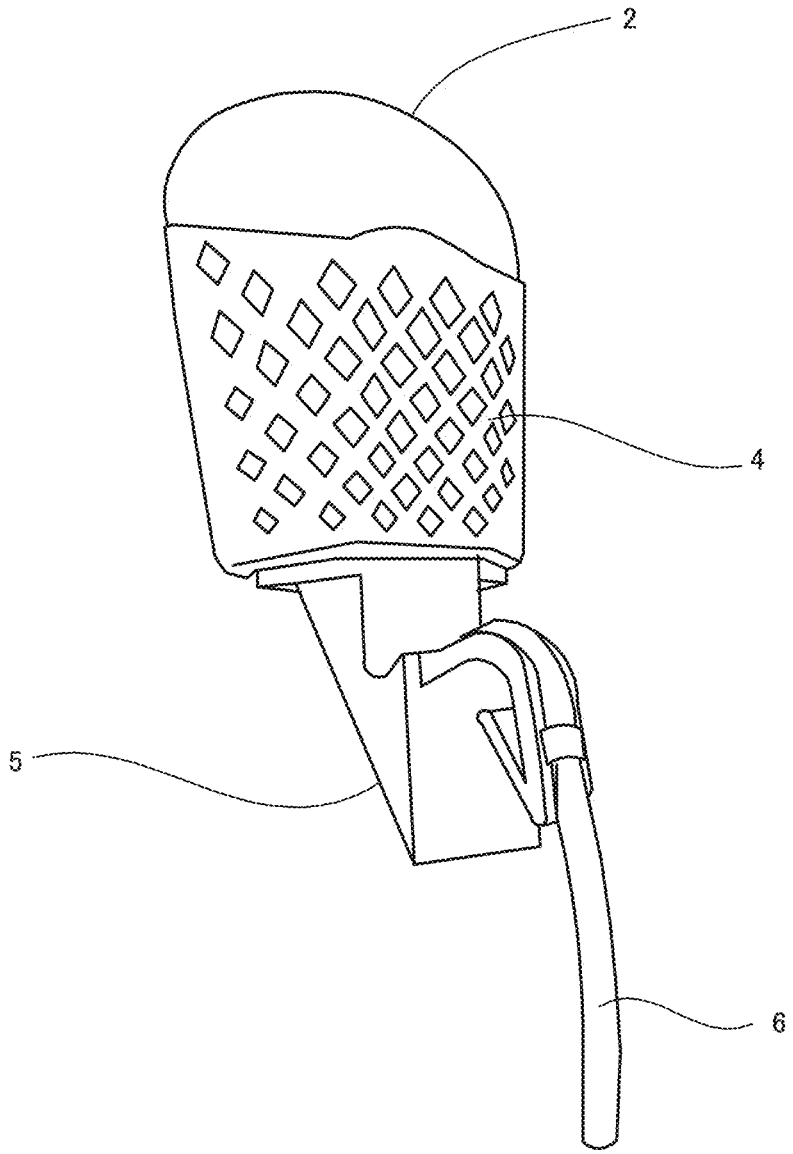
FIG. 1 is a perspective view of a chemical feeding device according to one embodiment of the present invention.

Hereinafter, a chemical feeding device according to one embodiment of the present invention will be described with reference to the drawings. FIG. 1 is a perspective view of the chemical feeding device according to the present embodiment, FIG. 2 is an exploded side view of the chemical feeding device in FIG. 1, and FIG. 3 is a cross-sectional view of a water tank.

Figure 2:
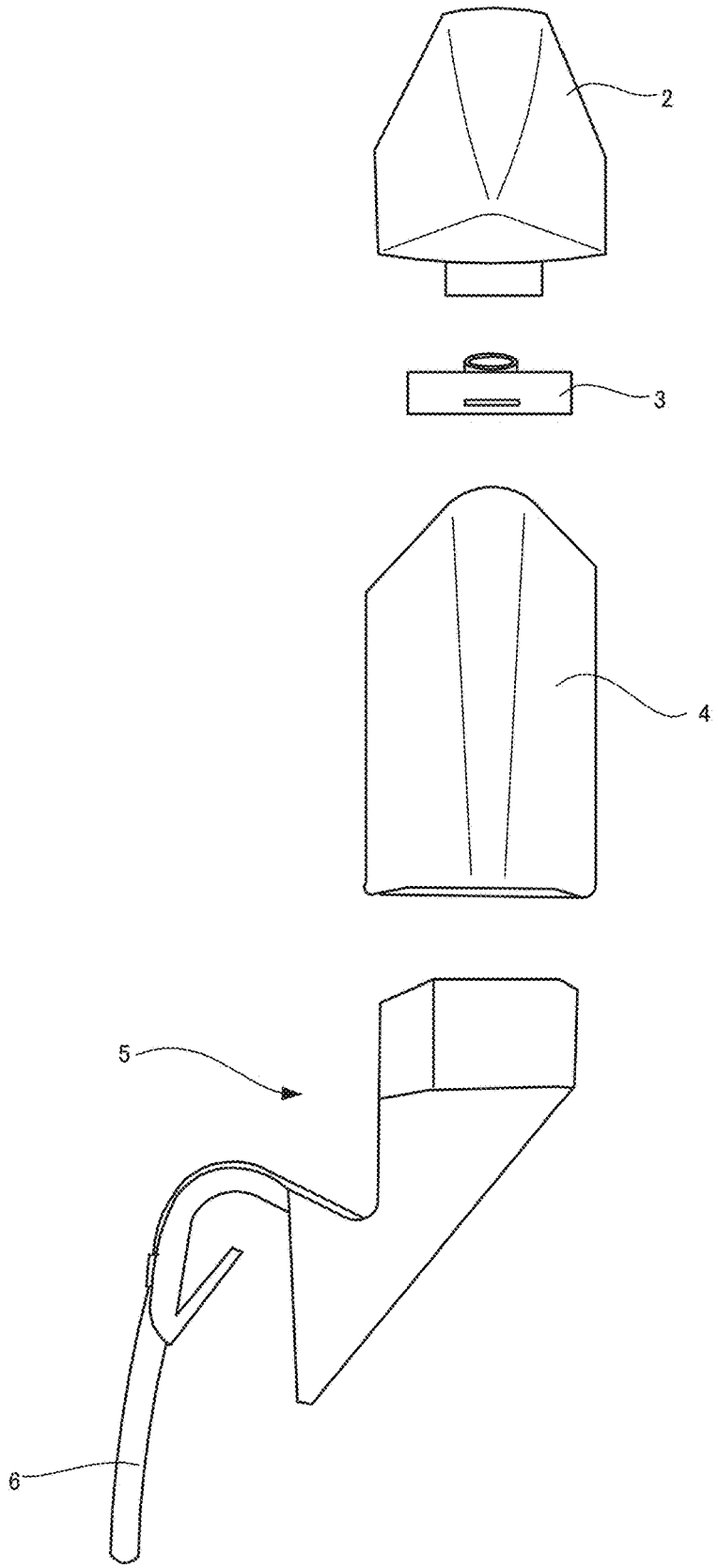
FIG. 2 is an exploded side view of the chemical feeding device in FIG. 1.

As shown in FIGS. 1 and 2, this chemical feeding device is a device for feeding a chemical solution to a water tank 1 of a toilet bowl, and includes a chemical container 2 storing the chemical solution, a chemical inducing member 3 for discharging the chemical solution from the chemical container 2, a support body 4 that supports the chemical container 2 and receives the chemical solution, and an attachment member 5 for attaching the support body 4 to the water tank 1 of the toilet bowl.

Figure 3:
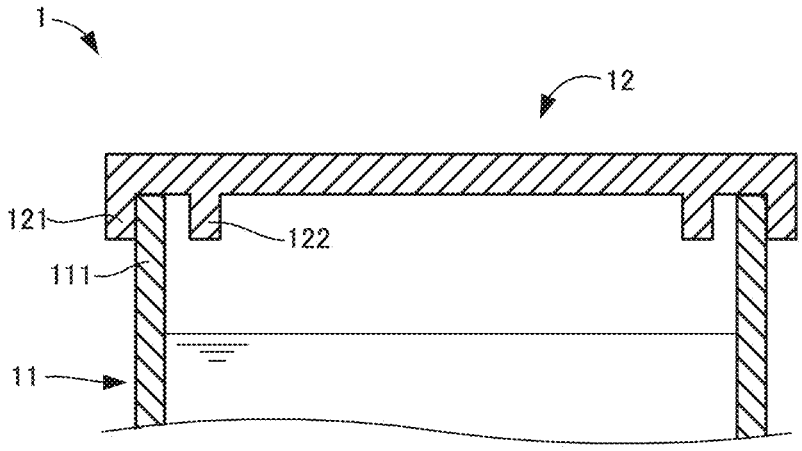
FIG. 3 is a cross-sectional view of a water tank.

As shown in FIG. 3, the water tank 1 to which the chemical feeding device is to be attached includes a tank main body 11 that holds flushing water to be flushed and a lid body 12 that covers an upper opening of the tank main body 11. The water tank 1 is provided, on the outer peripheral edge of the lid body 12, with a first edge portion 121 that extends downward and a second edge portion 122 that is disposed at an interval on the inner side of the first edge portion 121. An edge 111 of the upper opening of the tank main body 11 is configured to fit between the first edge portion 121 and the second edge portion 122 of the lid body 12. Thus, the lid body 12 is installed to protrude slightly on the outer side from the outer peripheral surface of the tank main body 11. The attachment member 5 described above is attached to be sandwiched between the tank main body 11 and the lid body 12. Hereinafter, each member of the chemical feeding device will be described in detail.

1. Chemical Container

Figure 4:
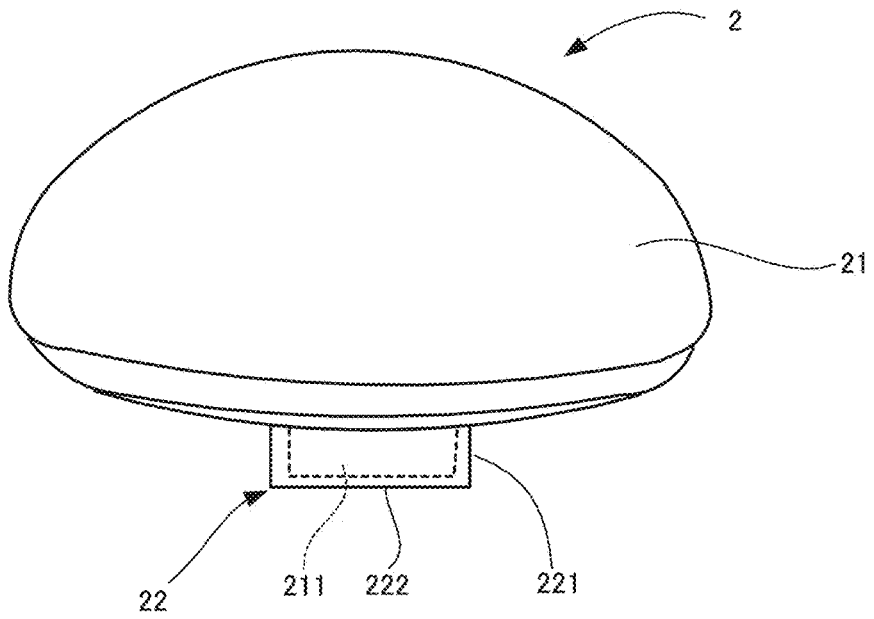
FIG. 4 is a perspective view of a chemical container.

FIG. 4 is a perspective view of the chemical container. As shown in FIG. 4, the chemical container 2 has a container main body 21 formed in a transparent dome shape with a flat lower surface, and the chemical solution is stored in this container main body 21. A discharge port 211 is formed in the lower surface of the container main body 21, and, prior to use, a cap 22 is attached to this discharge port 211. This cap 22 is constituted by an annular main body part 221 and a thin film part 222 that closes a hole in the middle of the main body part 221, and, at the time of use, the thin film part 222 is broken to discharge the chemical solution.

The chemical solution contains one or more elements selected from a group including a cleaning agent, a disinfecting agent, a deodorizing agent and a scenting agent, and may additionally contain a colorant. The chemical solution is mixed with the flushing water held in the water tank, and the efficacy of the components that are contained in the chemical solution is provided within the toilet bowl or within the toilet room. For example, when the chemical solution includes a cleaning agent and a disinfecting agent, the toilet bowl can be cleaned and disinfected, and when the chemical solution includes a deodorizing agent and a scenting agent, offensive odors can be removed from the toilet room and a pleasant scent can be dispersed.

2. Chemical Inducing Member

Figure 5:
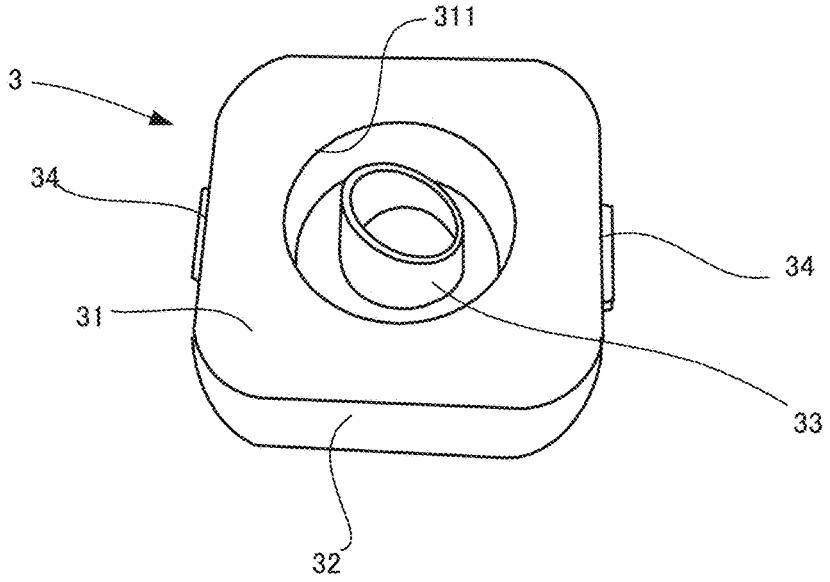
FIG. 5 is a perspective view of a chemical inducing member.

FIG. 5 is a perspective view of the chemical inducing member. The chemical inducing member 3 is a member for inducing the chemical solution discharged from the chemical container 2 to flow to the support body 4. As shown in FIG. 5, this chemical inducing member 3 has a rectangular upper surface part 31 and a side surface part 32 that extends downward from a peripheral edge portion of the upper surface part 31. Also, an annular recessed part 311 is formed in the middle of the upper surface part 31, and the main body part 221 of the cap 22 of the chemical container 2 is configured to fit into the recessed part 311. Also, a pointed cylindrical communicating tube 33 whose distal end is cut diagonally is provided on the inner side of the recessed part 311. This communicating tube 33 is configured to pierce the thin film part 222 of the cap 22 of the chemical container 2. The chemical solution in the chemical container 2 is thereby is configured to flow to a receiving part 42 of the support body 4 described next via the communicating tube 33. Also, protruding parts 34 are formed at opposite locations on the side surface part 32.

3. Support Body

Figure 6:
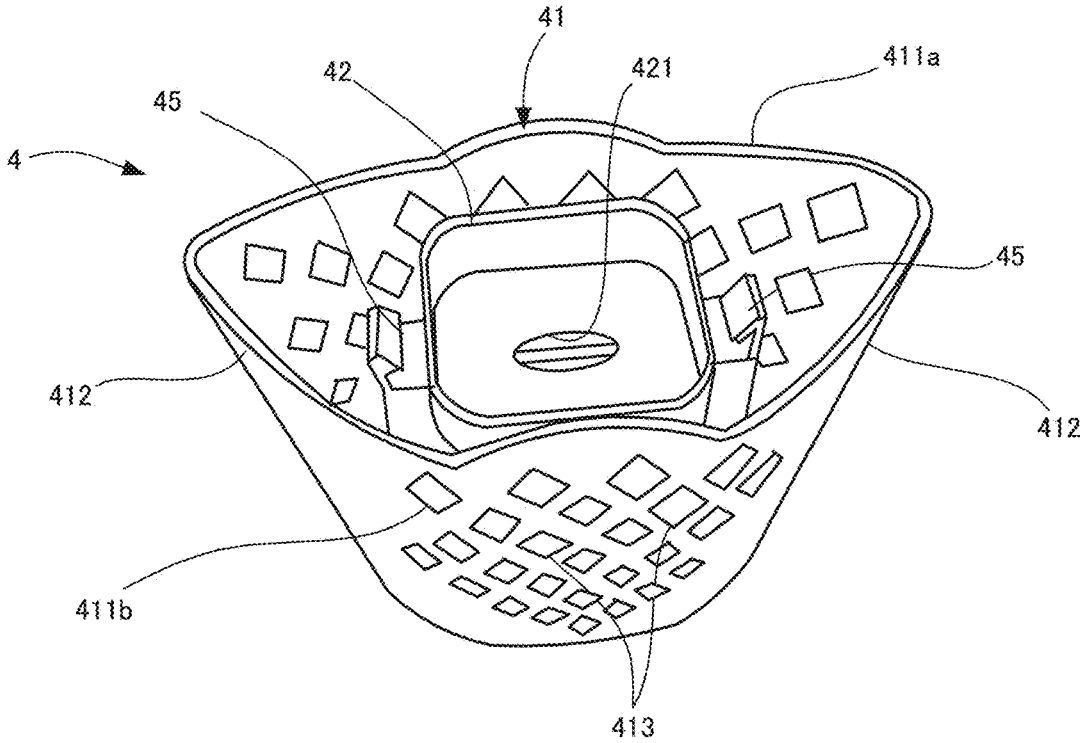
FIG. 6 is a perspective view of a support body seen from above.
Figure 7:
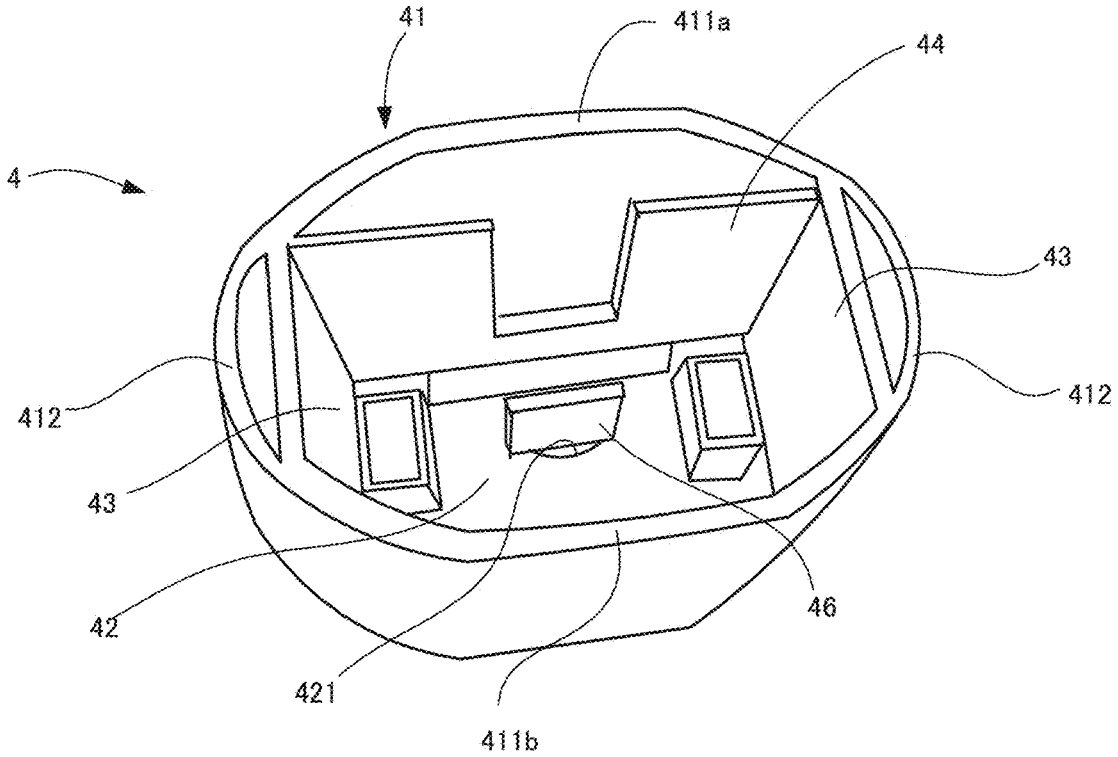
FIG. 7 is a perspective view of the support body seen from below.

Next, the support body 4 will be described. FIG. 6 is a perspective view of the support body seen from above, and FIG. 7 is a perspective view of the support body seen from below. As shown in FIGS. 6 and 7, the support body 4 has a casing 41 having an elliptical shape in plan view. The receiving part 42 to which the chemical inducing member 3 is attached, a pair of support plates 43 that are disposed downward of the receiving part 42 and support the receiving part 42, and a fixing plate 44 for fixing the attachment member 5 are provided in the internal space that is surrounded by the casing 41.

The casing 41 has a pair of long wall parts 411 that extend in the longitudinal direction and a pair of curved short wall parts 412 that extend in the transverse direction, and is configured to support the chemical container 2 with the upper ends of these wall parts. Also, a plurality of openings 413 are formed in the casing 41, and the internal space of the casing 41 communicates with the outside via these openings 413. Note that the openings 413 are omitted in some of the diagrams.

The pair of support plates 43 are disposed at a predetermined interval from each other in the internal space of the casing 41 and extend in the transverse direction. Both edge portions of each support plate 43 are connected to the inner wall surface of the casing 41. A receiving part 51 of the attachment member 5 described later is configured to be disposed between these support plates 43.

The fixing plate 44 is connected on either side to the support plates 43 and extends in the longitudinal direction between these support plates 43. Also, the fixing plate 44 is disposed on the same side as one of the long wall parts (hereinafter, referred to as a first long wall part 411*a*, with the other long wall part being referred to as a second long wall part 411*b*) with respect to the middle of the internal space in the transverse direction. The receiving part 51 of the attachment member 5 described later is configured to be fitted between the second long wall part 411*b* and the fixing plate 44. More specifically, the distance between the second long wall part 411*b* and the fixing plate 44 is slightly shorter than the length of the receiving part 51 in the transverse direction. Thus, the flexible receiving part 51 is configured to be press-fit between the second long wall part 411*b* and the fixing plate 44.

At the upper end portion of each support plate 43, engaging parts 45 that engage the protruding parts 34 on both sides of the chemical inducing member 3 while elastically deforming are provided, and the receiving part 42 that receives the chemical solution is disposed between these engaging parts 45. The receiving part 42 is formed in a rectangular cup shape in plan view, and a through hole 421 is formed in the middle of the bottom surface. The outer edge of the receiving part 42 is configured to enter the inner side of the side surface part 32 of the chemical inducing member 3. Also, a guide plate 46 that extends downward from the bottom surface of the receiving part 42 is formed, and the chemical solution that has passed through the through hole 421 is configured to flow downward along the guide plate 46. Note that the guide plate 46 is disposed near the middle of the casing 41 in the transverse direction and faces the second long wall part 411*b*.

4. Attachment Member

Figure 8:
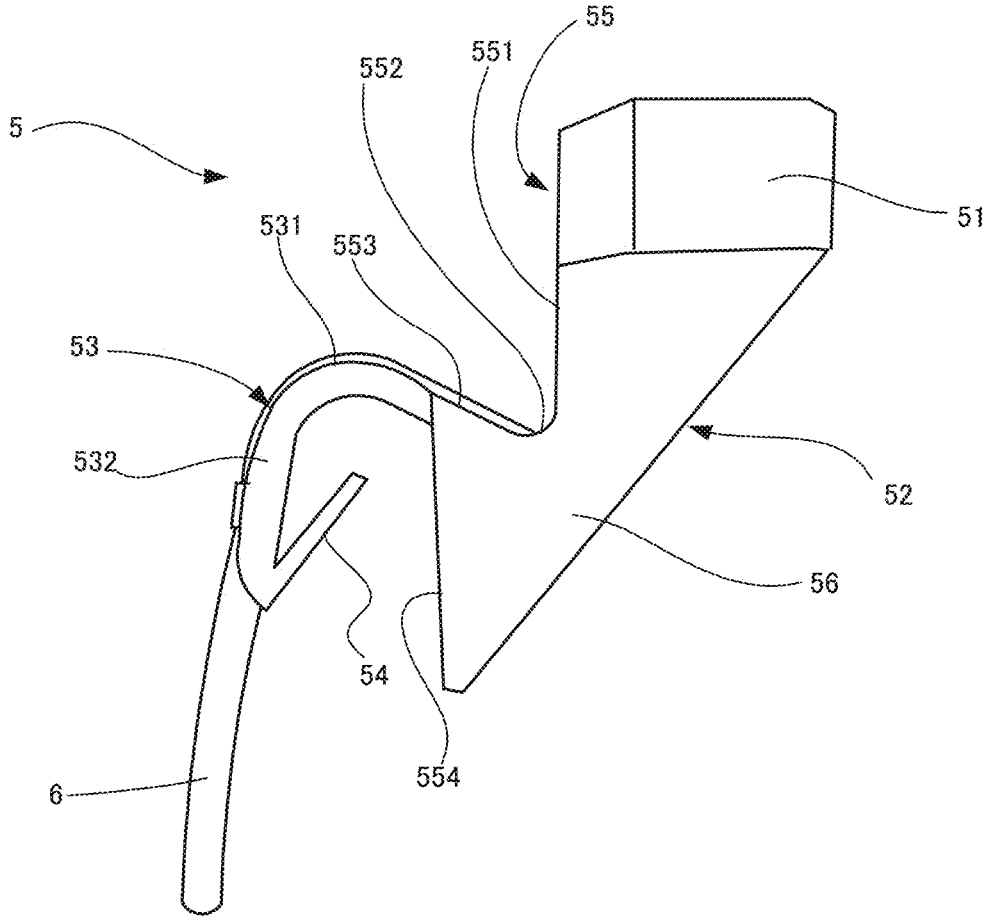
FIG. 8 is a side view of an attachment member.
Figure 9:
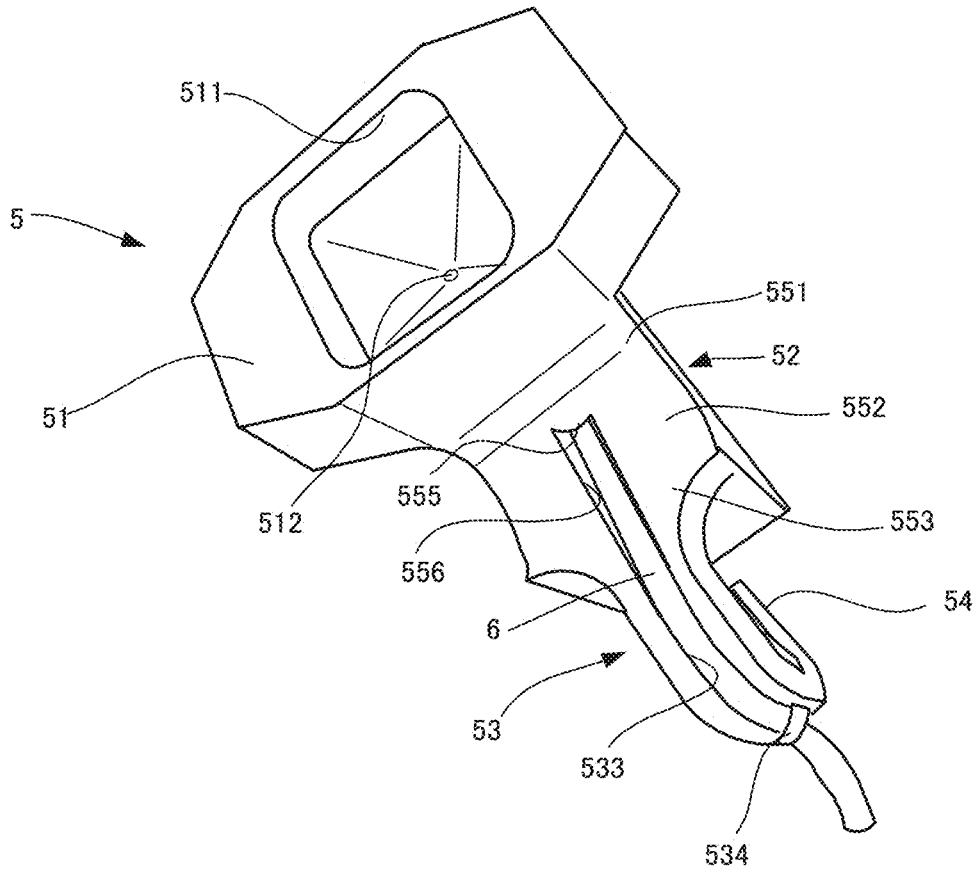
FIG. 9 is a perspective view of the attachment member seen from above.
Figure 10:
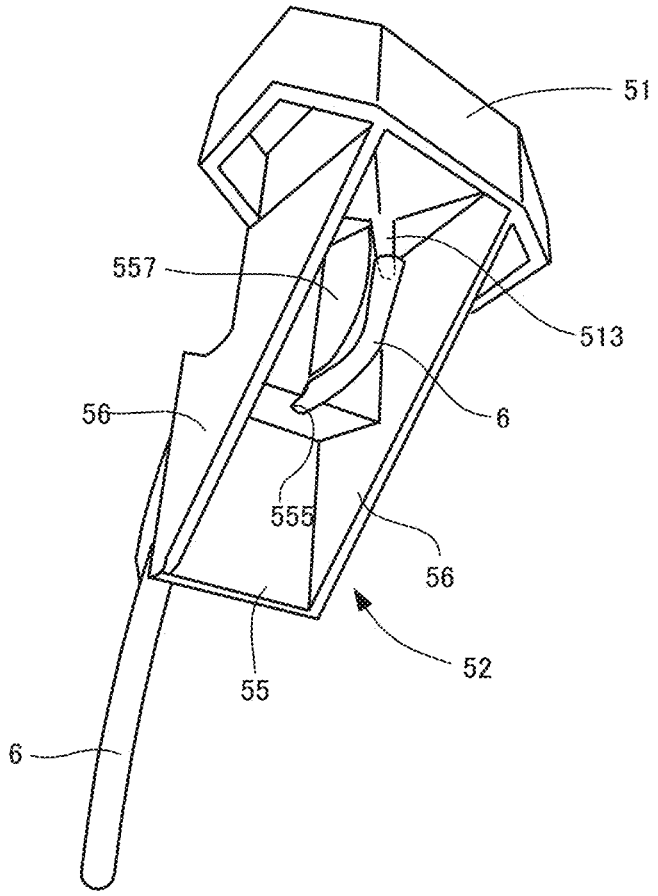
FIG. 10 is a perspective view of the attachment member seen from the back.

FIG. 8 is a side view of the attachment member, FIG. 9 is a perspective view of the attachment member seen from above, and FIG. 10 is a perspective view of the attachment member seen from the back. As shown in FIGS. 8 to 10, the attachment member 5 includes the receiving part 51 that is attached to the support body 4, an abutting part 52 that is connected to the lower end face of the receiving part 51, a fixing part 53 that extends to hook over the edge 111 of the tank main body 11 from the abutting part 52, and a folded part 54 that extends from the end portion of the fixing part 53 toward the abutting part 52 side, and these parts are integrally formed using a flexible material. Also, a known tube 6 having flexibility is attached to this attachment member 5.

The receiving part 51 is formed in an octagonal block shape in plan view, and a rectangular recessed part 511 is formed in the middle of the upper surface. The bottom surface of this recessed part 511 is formed in a conical shape, and a discharge hole 512 is formed in the lowermost portion of the bottom surface. A rod-shaped member 513 in which a through hole that communicates with the discharge hole 512 is formed is attached to the portion of the lower surface of the receiving part 51 where the recessed part 511 is formed. This rod-shaped member 513 is inserted into the upper end of the tube 6, and the chemical solution that accumulates in the recessed part 511 is configured to flow into the tube 6 via the discharge hole 512 and the through hole.

The abutting part 52 has a front plate 55 that extends downward from the receiving part 51 and a pair of side plates 56 that are respectively connected to either side of the front plate 55, with the front plate 55 being supported by the pair of side plates 56. The front plate 55 has a first extension surface 551 that extends downward from the outer peripheral surface of the receiving part 51 on the water tank 1 side, a curved surface 552 that curves down in a convex shape from the lower end of the first extension surface 551, a second extension surface 553 that extends diagonally upward from the curved surface 552, and an abutting surface 554 that extends downward from the end portion of the second extension surface 553. Also, the edge portion of each side plate 56 on the water tank 1 side is formed to follow the first extension surface 551, the curved surface 552, the second extension surface 553, and the abutting surface 554. On the other hand, the edge portion of each side plate 56 on the opposite side to the water tank 1 extends diagonally in a straight line from the lower end portion of the receiving part 51 to the lower end portion of the abutting surface 554.

In the front plate 55, a through hole 555 is formed in the curved surface 552, and a first groove 556 that extends on the water tank 1 side is formed in the second extension surface 553 to be continuous with the through hole 555. As described above, the tube 6 into which the rod-shaped member 513 is inserted is drawn out to the water tank 1 side via the through hole 555 and disposed to follow the first groove 556 in the second extension surface 553. The first groove 556 is formed in an arc shape in cross-section, and is formed such that 30 percent or more, and preferably 50 percent or more, of the cross-sectional area of the tube 6 fits therein.

Also, in the front plate 55, a plate-shaped guiding member 557 is disposed on the back surface of the first extension surface 551. This guiding member 557 extends upward from the upper edge of the through hole 555 and is disposed with a gap to the rod-shaped member 513. Also, the outer edge of the guiding member 557 from the rod-shaped member 513 to the through hole 555 is formed in an arc shape. Thus, the tube 6 into which the rod-shaped member 513 is inserted is disposed to follow the outer edge of the guiding member 557 and is guided toward the through hole 555.

Next, the fixing part 53 will be described. The fixing part 53 is formed in a band shape that, in an initial state, has a curved part 531 that extends up in a convex shape from the upper end of the second extension surface 553 described above, and an extension part 532 that extends downward from the distal end of the curved part 531. A second groove 533 that is continuous with the first groove 556 formed in the second extension surface 553 is formed in the fixing part 53. The second groove 533 has a similar cross-sectional shape to the first groove 556 and extends throughout the curved part 531 to the extension part 532. Also, a retaining part 534 is formed on the extension part 532 to cover the second groove 533, and the tube 6 fitted in the second groove 533 is covered by the retaining part 534 so as to not detach. Note that the tube 6 is of a length that extends downward past the lower end of the extension part 532.

The band-shaped folded part 54 that extends diagonally upward toward the abutting surface 554 is connected to the lower end of the extension part 532. The folded part 54 is elastically deformable and is thus configured to approach the extension part 532 side due to a force being applied thereto.

That is, the angle formed by the folded part 54 and the extension part 532 decreases when the folded part 54 is pressed.

The attachment member 5 constituted as described above is integrally formed using a flexible material. The material constituting the attachment member 5 is not particularly limited, and the attachment member 5 can be formed with a material such as polyurethane rubber, styrene-butadiene rubber, silicone rubber or fluoro rubber. The hardness (international rubber hardness) of the attachment member 5 is preferably from 60 to 100 IRHD, and more preferably from 85 to 95 IRHD. The international rubber hardness can be measured with a test stipulated in JIS K 6253-2 (ISO 480), for example.

5. Assembly and Usage of Chemical Feeding Device

Next, assembly and usage of the chemical feeding device using the members constituted as described above will be described. First, the chemical inducing member 3 is attached to the support body 4. That is, the chemical inducing member 3 is attached to cover the receiving part 42 of the support body 4. At this time, the chemical inducing member 3 is fixed to the support body 4, due to the protruding parts 34 of the chemical inducing member 3 engaging the engaging parts 45 of the support body 4.

Figure 11:
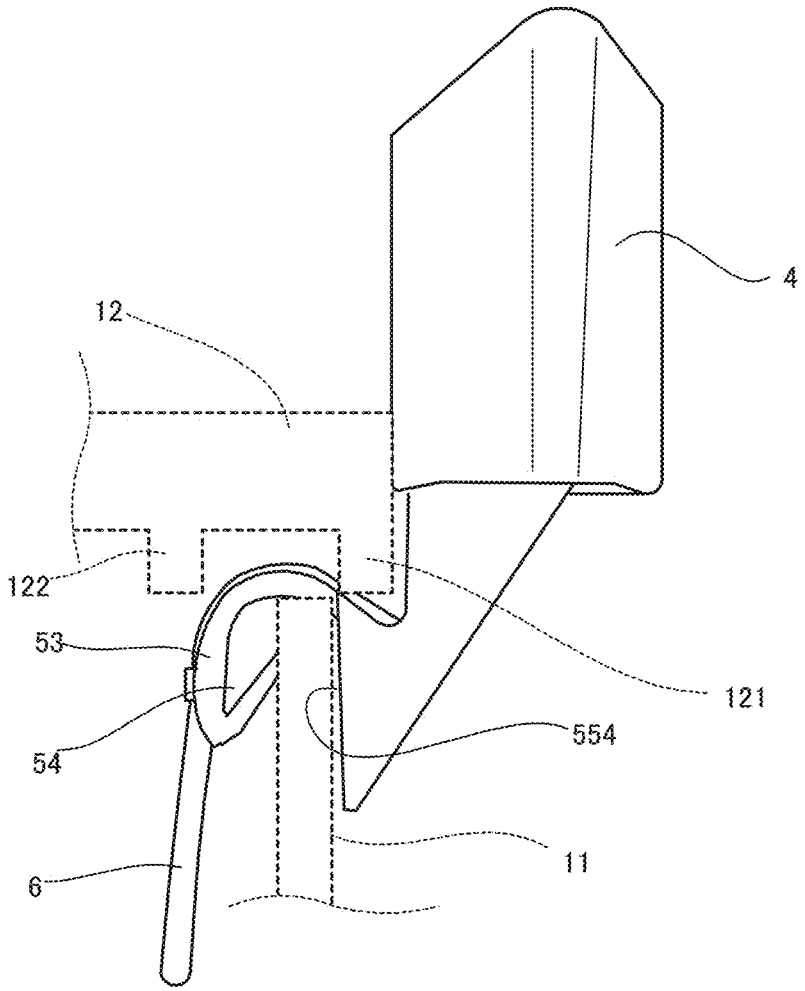
FIG. 11 is a side view showing an example of attaching the chemical feeding device to the water tank.
Figure 12:
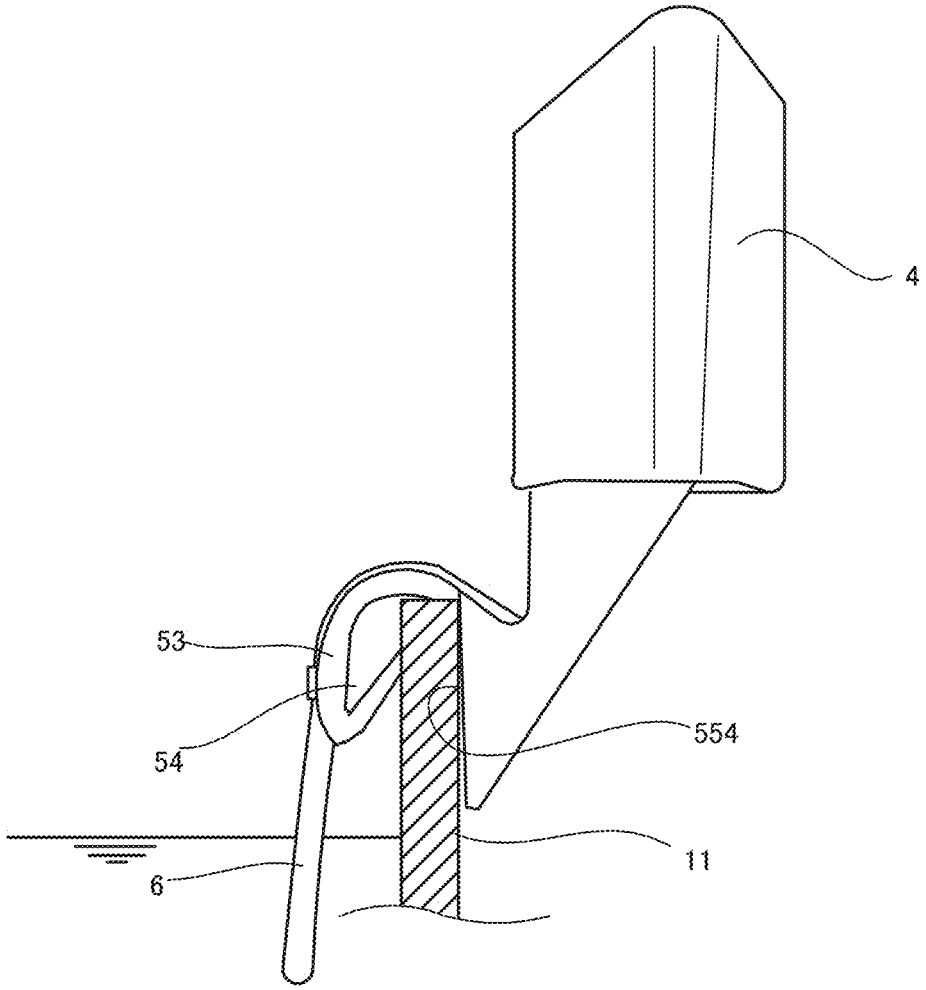
FIG. 12 is a side view showing attachment of the chemical feeding device to the water tank.

Next, the attachment member 5 is attached to the support body 4. At this time, the method of attaching the attachment member 5 differs depending on the position of the lid body 12 of the water tank 1. In the case where the lid body 12 juts out laterally from the tank main body 11 as shown in FIG. 3, for example, the support body 4 needs to be prevented from interfering with the lid body 12. Thus, the receiving part 51 is fitted into the support body 4, such that the surface of the receiving part 51 of the attachment member 5 on the front plate 55 side comes into contact with the second long wall part 411*b* of the support body 4. As shown in FIG. 11, the first extension surface 551 of the attachment member 5 will thereby be generally flush against the second long wall part 411*b* of the support body 4, thus suppressing interference between the support body 4 and the lid body 12.

Also, since the receiving part 51 of the attachment member 5 is disposed at a position displaced from the center of the casing 41 of the support body 4 in the transverse direction, the conical bottom surface of the recessed part 511 of the receiving part 51, rather than the discharge hole 512 in the receiving part 51, is disposed directly below the guide plate 46. Accordingly, the chemical solution that runs along the guide plate 46 drips onto the conical bottom surface.

Figure 13:
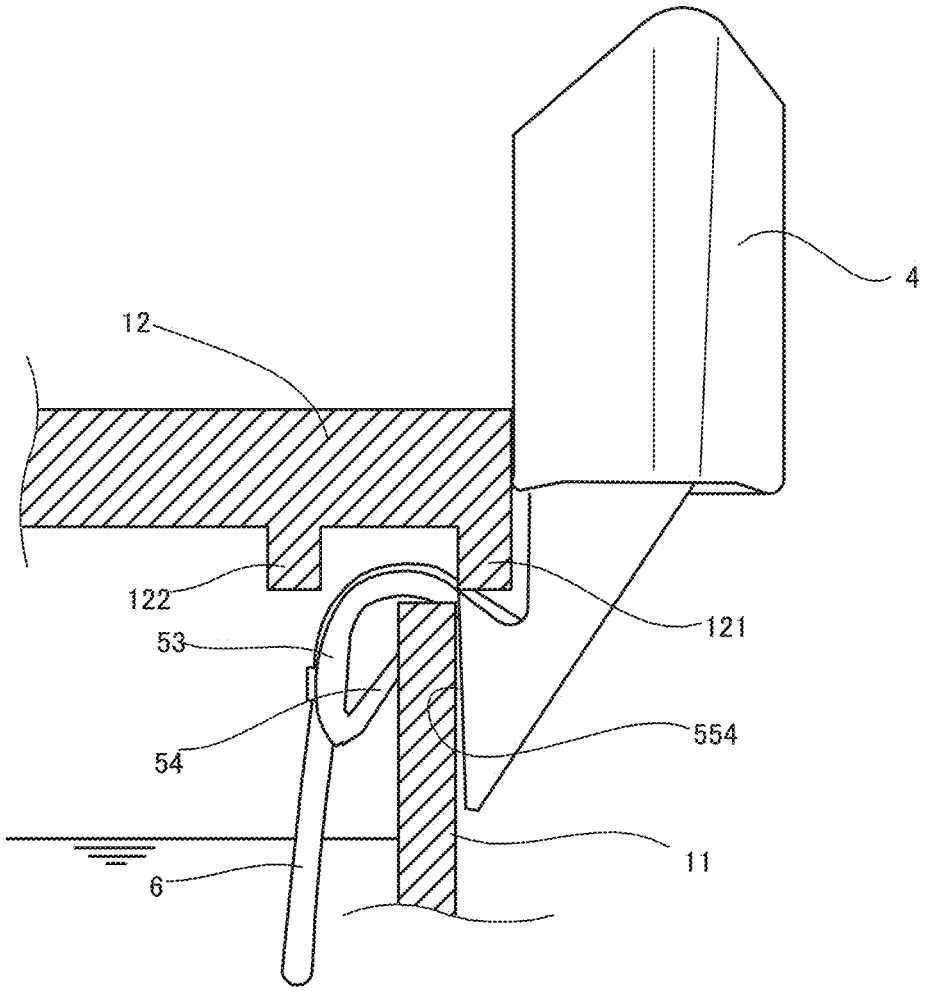
FIG. 13 is a side view showing attachment of the chemical feeding device to the water tank.

Next, the attachment member 5 is attached to the water tank. First, the lid body 12 is moved from the tank main body 11 to expose the upper edge 111 of the tank main body 11. Next, as shown in 12, the fixing part 53 is attached to straddle the edge 111 of the tank main body 11 from above. At this time, the abutting surface 554 of the attachment member 5 abuts the outer surface of the edge 111 of the tank main body 11, and the folded part 54 presses on the inner wall surface of the edge 111. Accordingly, the edge 111 of the tank main body 11 is sandwiched between the abutting surface 554 and the folded part 54, and the attachment member 5 is thereby fixed to the tank main body 11. Subsequently, when the lid body 12 is attached to the tank main body 11, the fixing part 53 is disposed between the first edge portion 121 and the second edge portion 122 of the lid body 12, as shown in FIG. 13. Also, the first edge portion 121 presses on the attachment member 5 in the vicinity of the curved surface 532 and the second extension surface 553 (this portion constitutes the installation surface of the present invention). Since the tube 6 is, however, fitted into the first groove 556, the entirety of the tube 6 is inhibited from being pressed by the first edge portion 121.

Figure 14:
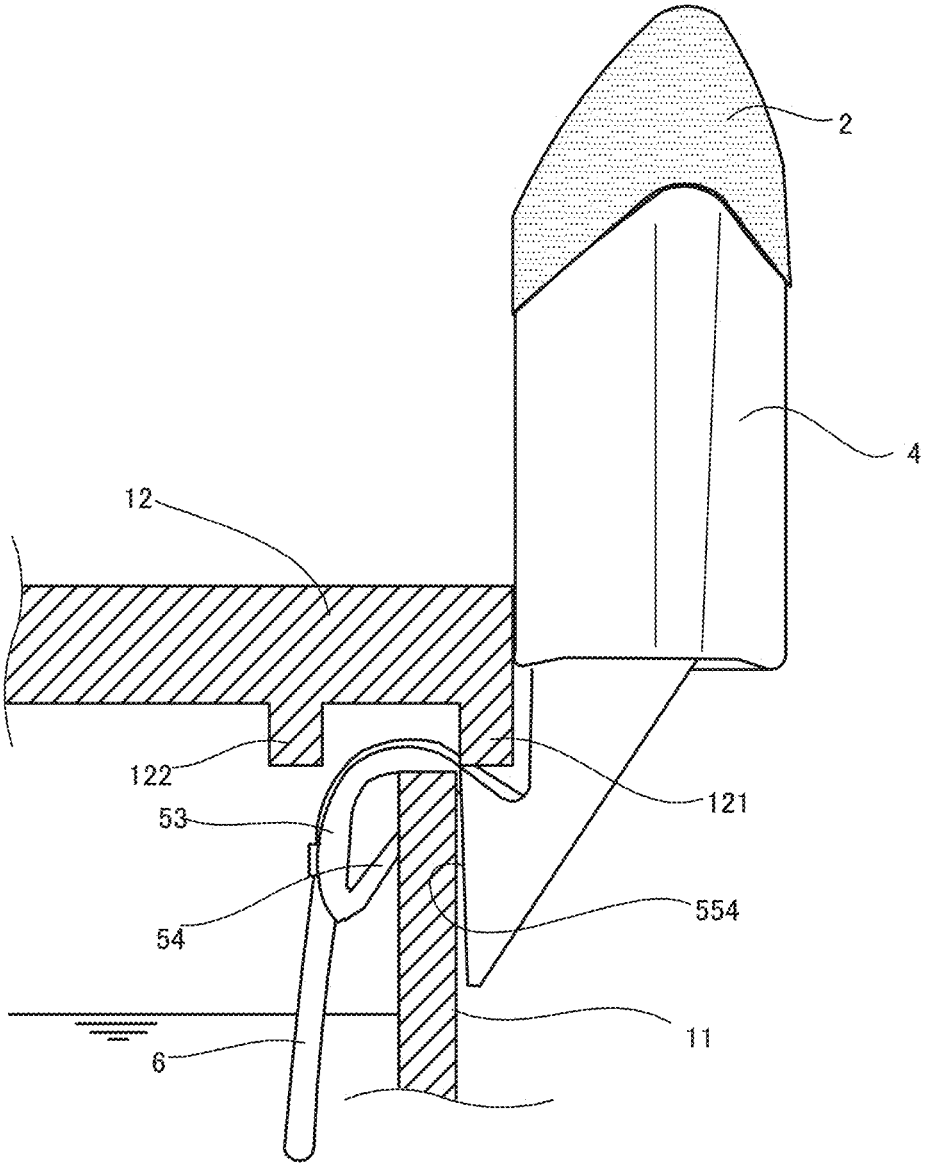
FIG. 14 is a side view showing attachment of the chemical feeding device to the water tank.

After attaching the attachment member 5 to the water tank 1 in this manner, the chemical container 2 is attached to the support body 4, as shown in FIG. 14. Since the communicating tube 33 of the chemical inducing member 3 is pierced into the thin film part 222 of the cap 22 of the chemical container 2, the chemical solution thereby flows into the receiving part 42 of the support body 4, through the communicating tube 33. This chemical solution then flows downward from the through hole 421 in the receiving part 42 along the guide plate 46. The chemical solution drips from the lower end of the guide plate 46 into the recessed part 511 of the receiving part 51 of the attachment member 5. At this time, the chemical solution drips from the lower end of the guide plate 46 onto the conical bottom surface of the recessed part 511, rather than into the discharge hole 512, and flows along the bottom surface and enters the discharge hole 512. The chemical solution that enters the discharge hole 512 flows into the tube 6 and is fed from the tube 6 into the flushing water held in the water tank 1.

The chemical solution held together with the flushing water in the water tank 1 thus has a scented deodorizing effect due to the scented component. Also, the toilet bowl is cleaned by the chemical solution flowing from the water tank 1 into the toilet bowl when the toilet is flushed, and a scented deodorizing effect can also be obtained. Note that the chemical feeding device can also be attached to the water tank 1 after attaching the chemical container 2 to the support body 4.

6. Features

With the chemical feeding device constituted as described above, the following effects can be obtained.

(1) This chemical feeding device has the attachment member 5 that is configured to be attachable to the edge 111 of the tank main body 11, thus enabling the chemical feeding device to be attached to a water tank that is not provided with a water receptacle. Also, the flexible tube 6 that guides the chemical solution in the chemical container 2 to the water tank 1 is supported by the attachment member 5, thus enabling the chemical solution in the chemical container 2 to be fed to the water tank 1 in a stable manner by this tube 6.

(2) The fixing part 53 and the folded part 54 are deformable, thus enabling the attachment member 5 to be attached to the edge 111 of the tank main body 11 over various edge widths. In the example of FIG. 14 described above, the width of the edge 111 of the tank main body 11 is narrow, that is, the width of the edge 111 is shorter than the distance between the abutting surface 554 and the extension part 532 of the fixing part 53, but in the case where the width of the edge 111 of the tank main body 11 is wide, the attachment member 5 can be attached as follows.

Figure 15:
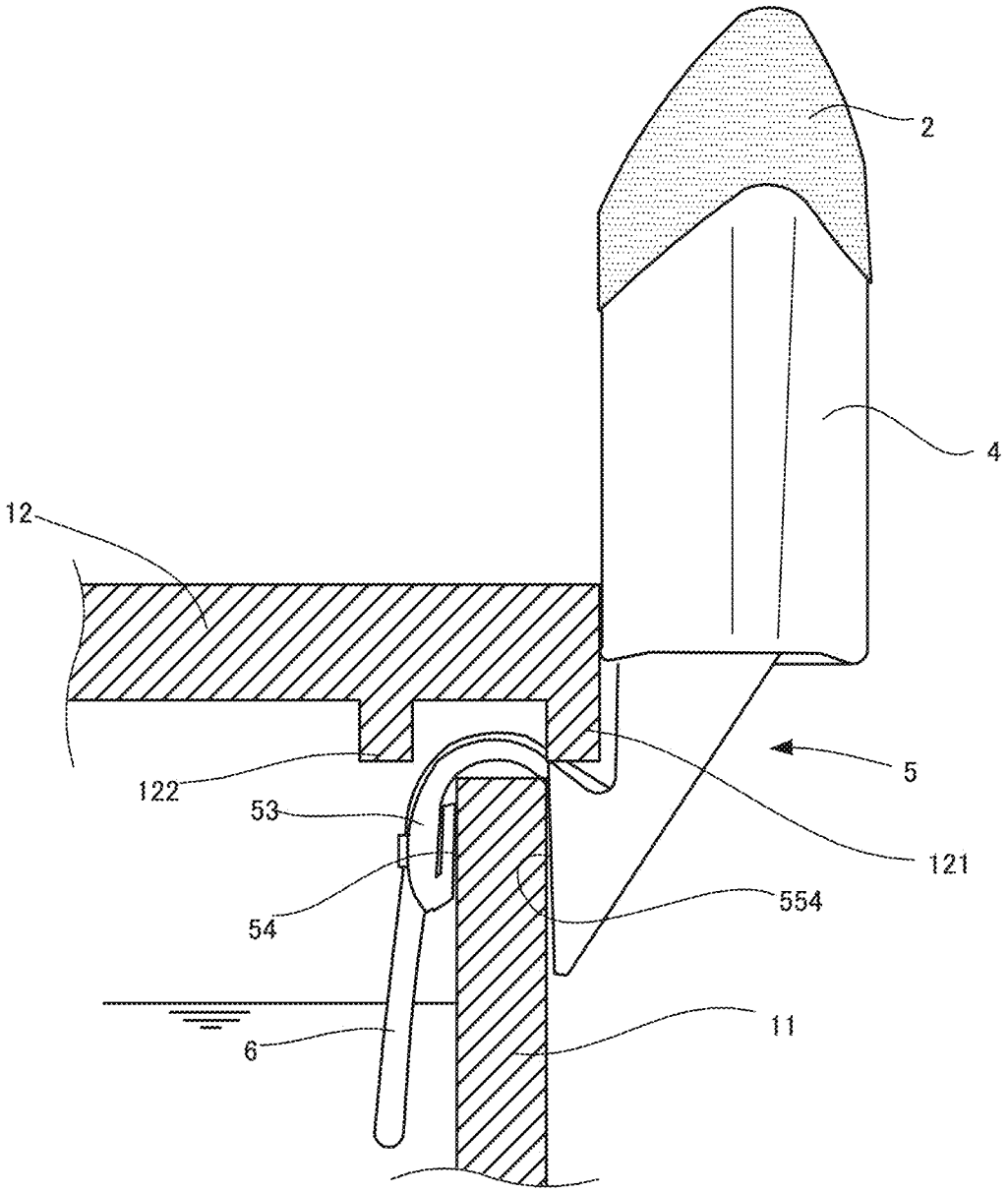
FIG. 15 is a side view showing attachment of the chemical feeding device to another water tank.

As shown in FIG. 15, in the case where the width of the edge 111 of the tank main body 11 is slightly wider, the edge 111 presses on the folded part 54 and the folded part 54 comes into contact with the extension part 532 of the fixing part 53. Also, the edge 111 of the tank main body 11 is sandwiched between the abutting surface 554 and the folded part 54. In this case, the edge 111 of the tank main body 11 is generally sandwiched by the elastic force of the fixing part 53. In other words, in the case where the width of the edge 111 of the tank main body 11 is generally equal to the distance between the extension part 532 of the fixing part 53 and the abutting surface 554, the edge 111 will be sandwiched in this way.

Figure 16:
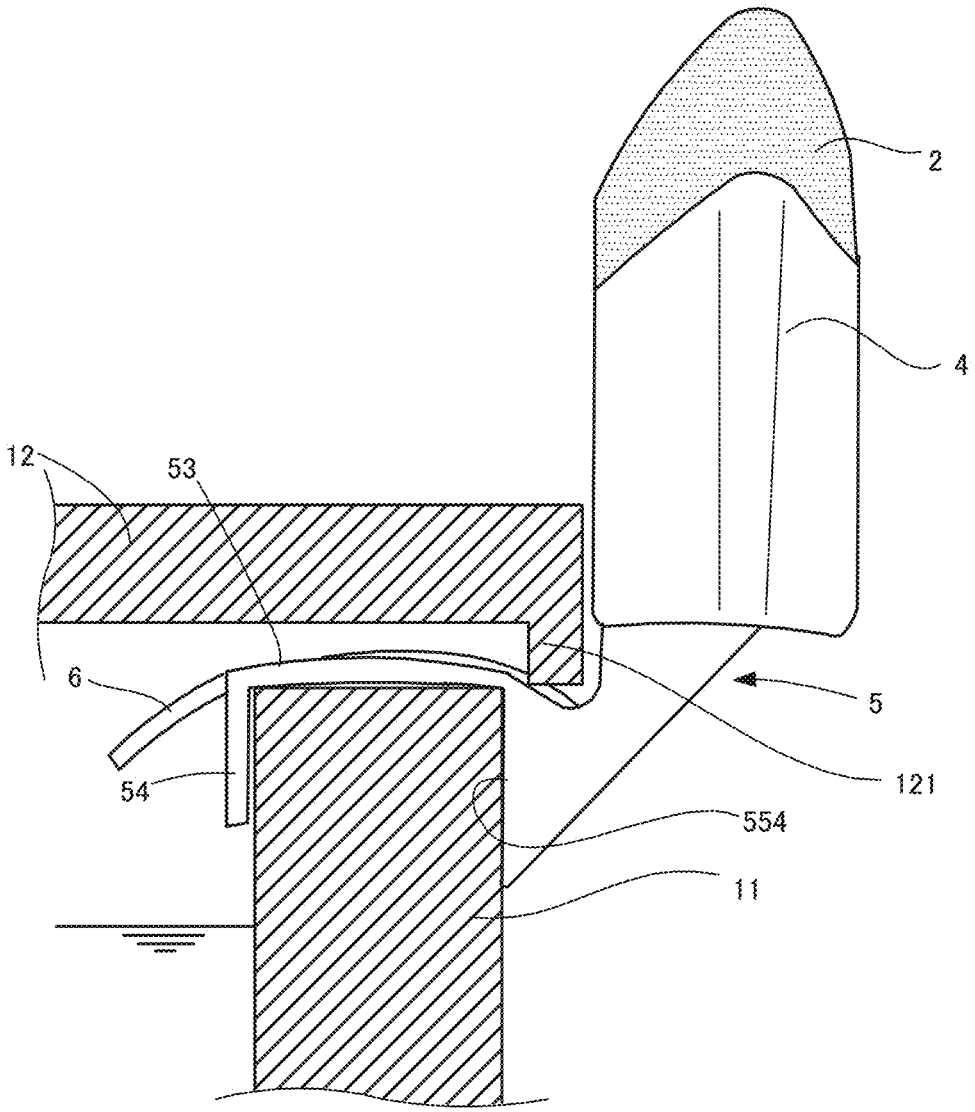
FIG. 16 is a side view showing attachment of the chemical feeding device to another water tank.

As shown in FIG. 16, in the case where the width of the edge 111 of the tank main body 11 is wide, the curved fixing part 53 is extended linearly, and the angle between the folded part 54 and the extension part 532 is further widened to generally 90 degrees. The edge 111 of the tank main body 11 can thereby be sandwiched between the abutting surface 554 and the folded part 54. That is, in the case where the width of the edge 111 of the tank main body 11 is longer than the distance between the extension part 532 of the fixing part 53 and the abutting surface 554, the edge 111 will be sandwiched in this way.

Figure 17:
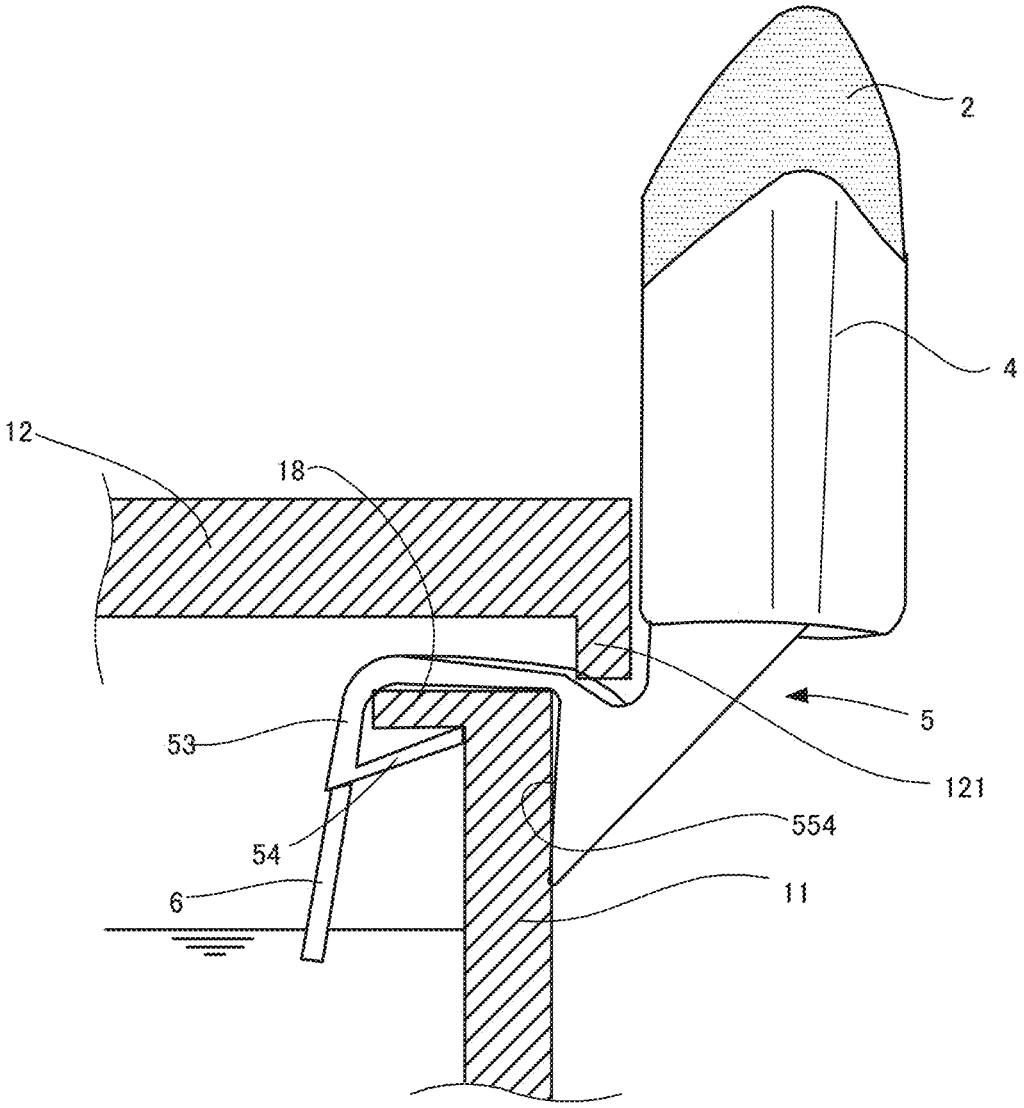
FIG. 17 is a side view showing attachment of the chemical feeding device to another water tank.

As shown in FIG. 17, when a flange 18 that extends inwardly is formed on the edge 111 of the tank main body 11, the curved fixing part 53 is extended linearly, and this linearly extended portion is disposed along the upper surface of the flange 118. At this time, the folded part 54 engages the lower surface of the flange 18.

In this way, the attachment member 5 according to the present embodiment can be attached to the edge 111 of the tank main body 11 over various edge widths.

Figure 18:
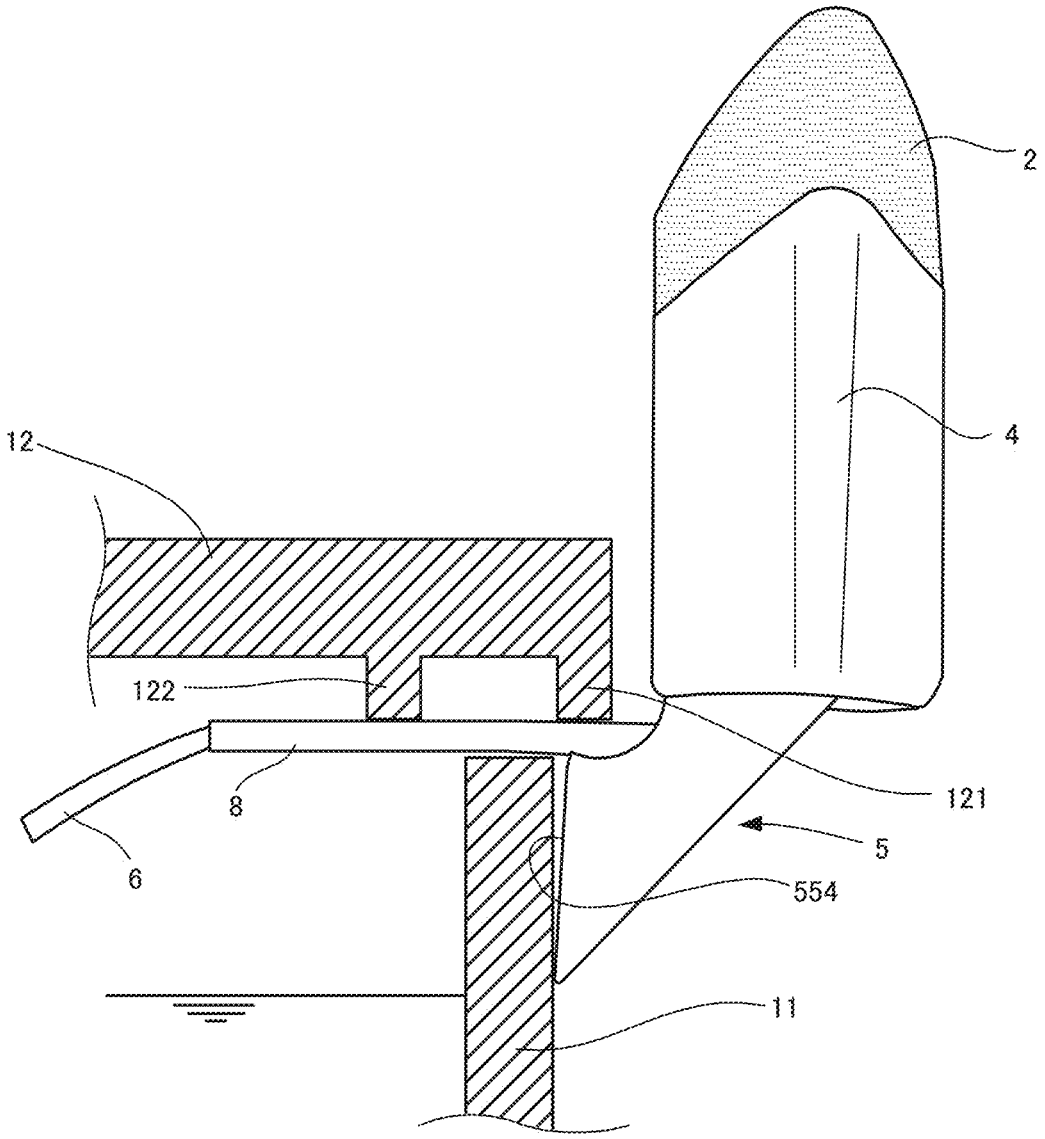
FIG. 18 is a side view showing attachment of a chemical feeding device in which a fixing part is linearly formed to a water tank.

(3) The fixing part 53 has the curved part 531 that has an upwardly convex shape, thus enabling the fixing part 53 to be disposed to hook over the edge 111 of the tank main body 11. For example, as shown in FIG. 18, when a firing part 8 extends linearly, there is a chance that the lid body 12 will ride up on the fixing part 8 and the lid body 12 will be slanted or the attachment member 5 will be slated. In contrast, when the fixing part 53 is formed as described above, the fixing part 53 is disposed to hook over the edge 111 of the tank main body 11, thus enabling interference between the fixing part 53 and the portion where the tank main body 11 and the lid body 12 fit together to be suppressed. As a result, it is possible to inhibit the lid body 12 from being disposed at a slant. Further, since it is possible to inhibit the attachment member 5 from being disposed at a slant, it is also possible to inhibit the chemical container 2 from being slanted.

Figure 19:
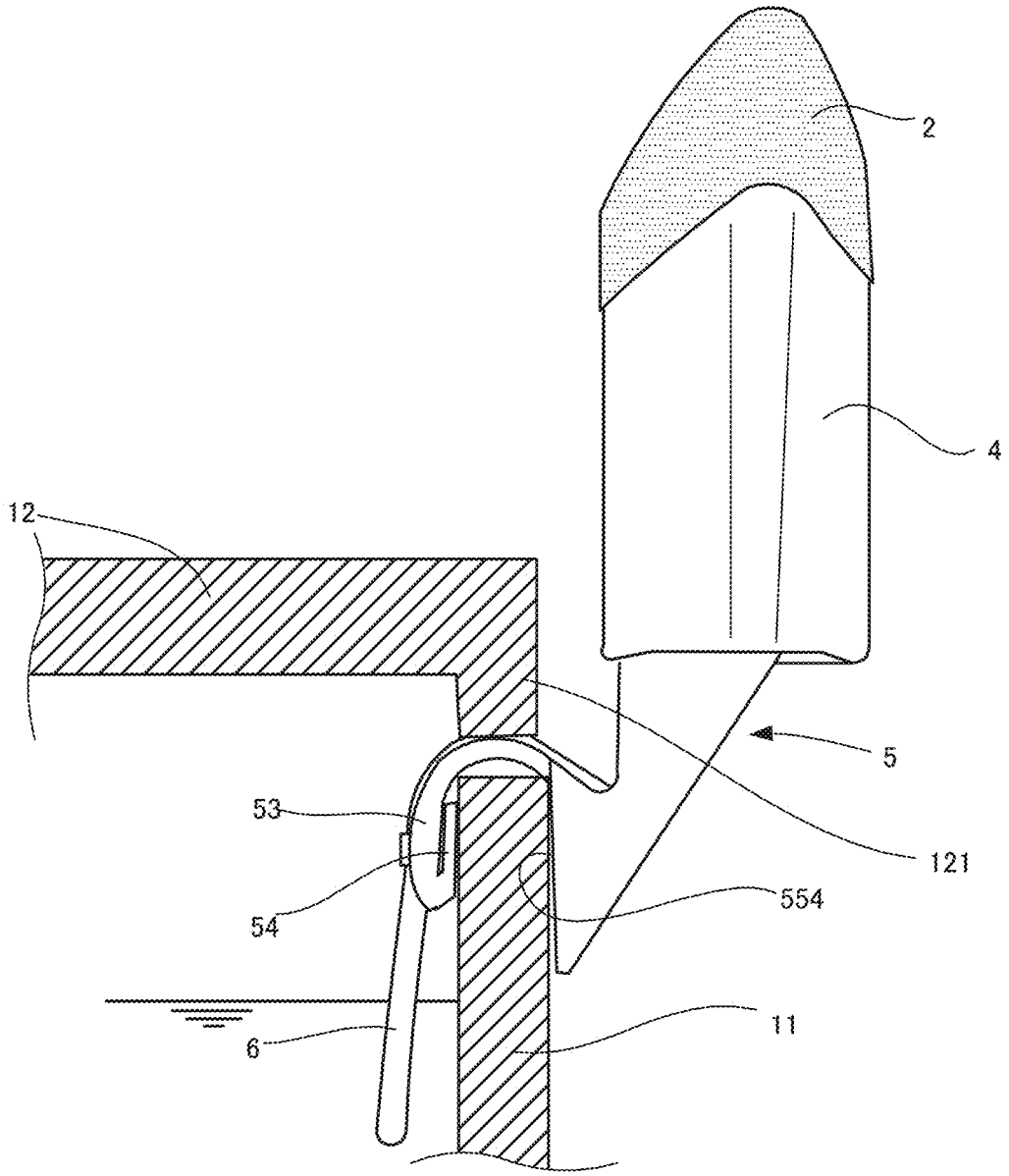
FIG. 19 is a side view showing attachment of the chemical feeding device to another water tank.

In addition to the water tank 1 of the modes described above, the attachment member 5 can also be attached to water tanks such as the following. In the example of FIG. 19, only the first edge portion 121 that extends downward at the outer peripheral edge of the lid body 12 is provided, and this first edge portion 121 is in contact with the edge 111 of the tank main body 11. In this case, since the fixing part 53 is disposed to straddle the edge 111 of the tank main body 11, the attachment member 5 is attachable. Also, the first edge portion 121 of the lid body 12 presses on the fixing part 53 in the vicinity of the curved part 531, but since the tube 6 is inserted in the second groove 533, the entirety of the tube 6 is inhibited from being pressed by the first edge portion 121. Accordingly, flow of the chemical solution is prevented from being impeded.

Figure 20:
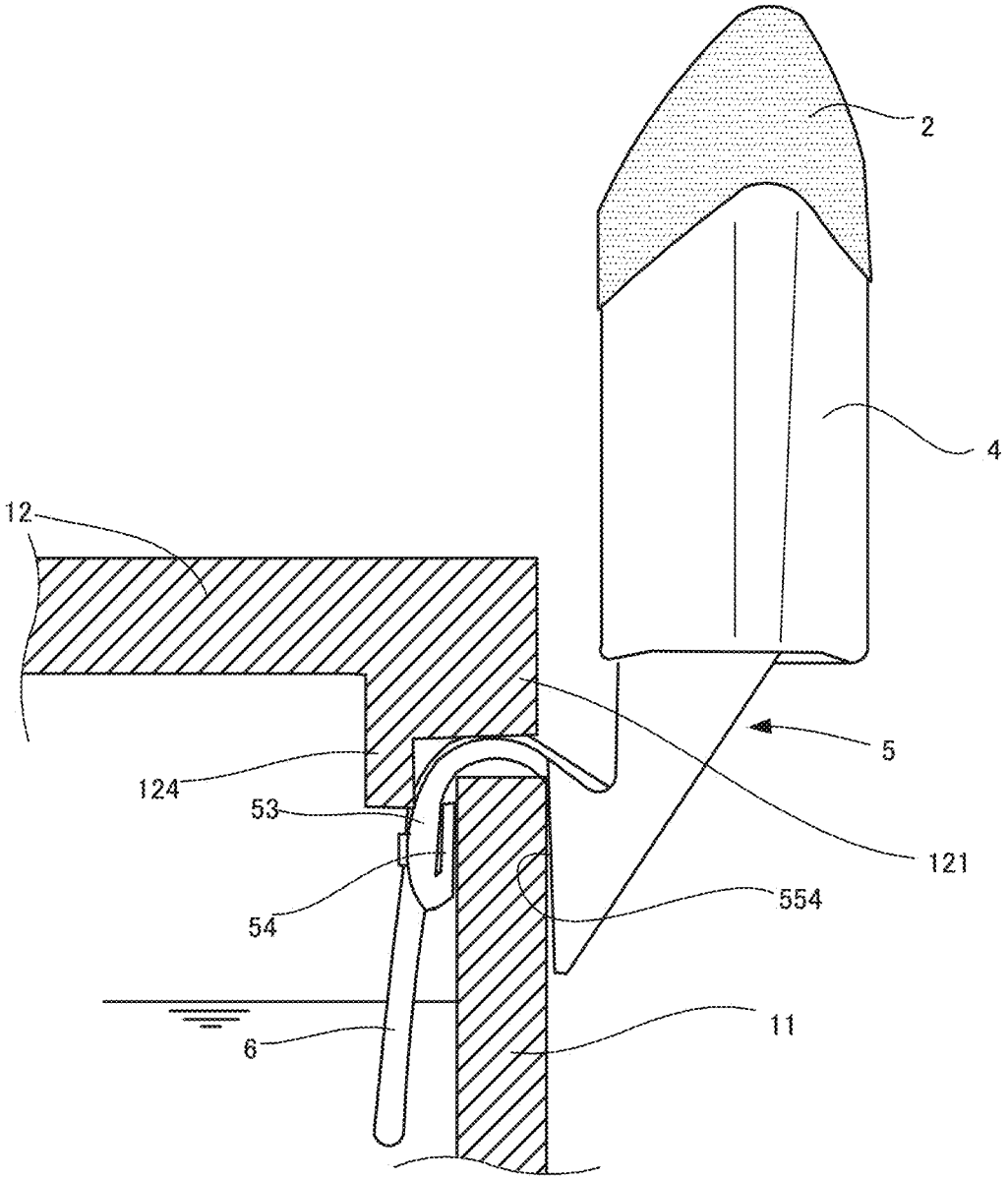
FIG. 20 is a side view showing attachment of the chemical feeding device to another water tank.

In the example of FIG. 20, the first edge portion 121 extends downward at the outer peripheral edge of the lid body 12, but the width of the first edge portion 121 is wider than the edge 111 of the tank main body 11. Also, a protruding part 124 disposed on the inner surface side of the edge 111 of the tank main body 11 is formed on the lower end of the first edge portion 121. In this case, again, since the fixing part 53 is disposed to straddle the edge 111 of the tank main body 11, the attachment member 5 is attachable.

Figure 21:
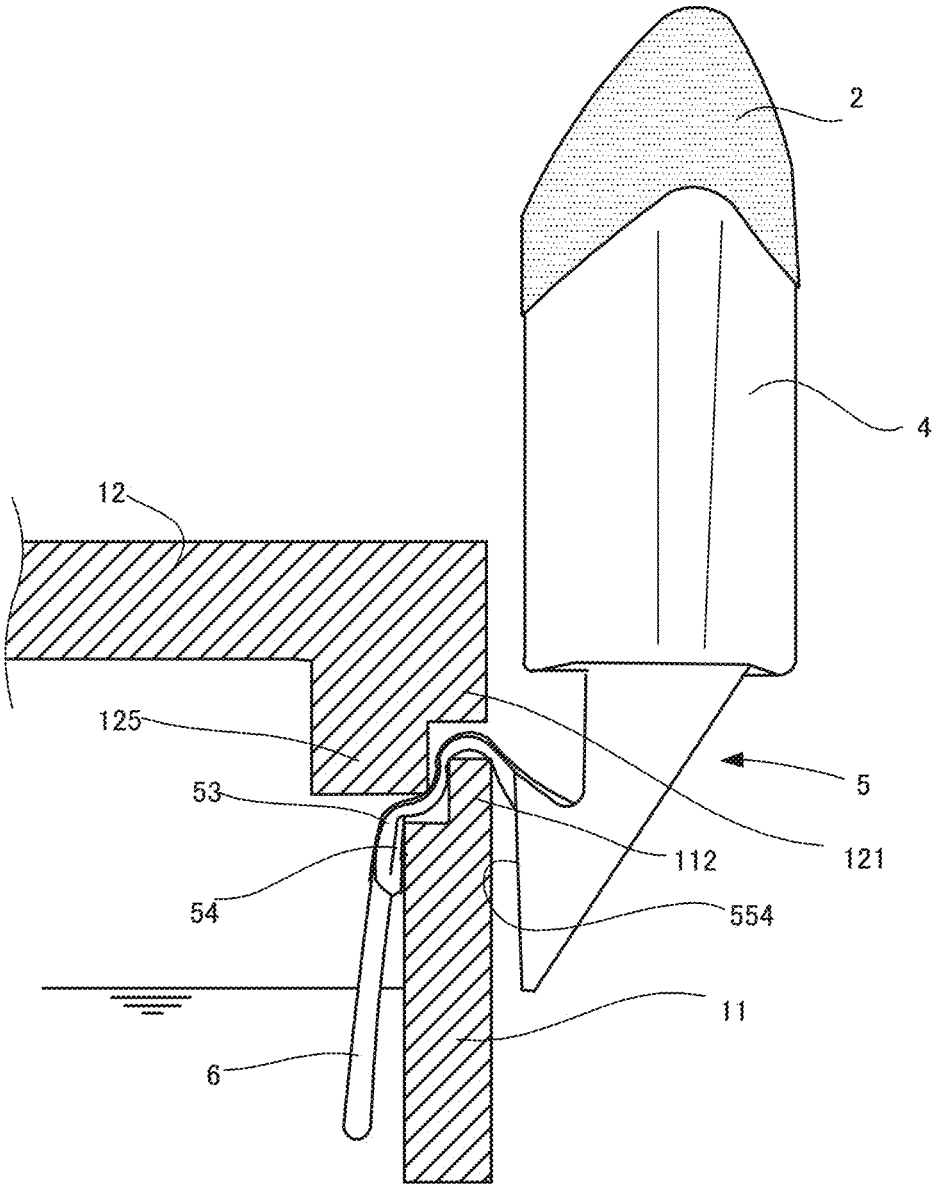
FIG. 21 is a side view showing attachment of the chemical feeding device to another water tank.

In the example of FIG. 21, the first edge portion 121 extends downward at the outer peripheral edge of the lid body 12, but the width of the first edge portion 121 is wider than the edge 111 of the tank main body 11. On the other hand, a protruding part 112 that protrudes upward is formed on the outer side of the upper end face of the edge 111 of the tank main body 11. Also, a protruding part 125 that is disposed on the inner surface side of the edge 111 of the tank main body 11 is formed on the lower end of the first edge portion 121, and this protruding part 125 is disposed on the inner side of the protruding part 112 of the tank main body 11. In this case, again, since the fixing part 53 is disposed to straddle the edge 111 of the tank main body 11, the attachment member 5 is attachable.

Figure 22:
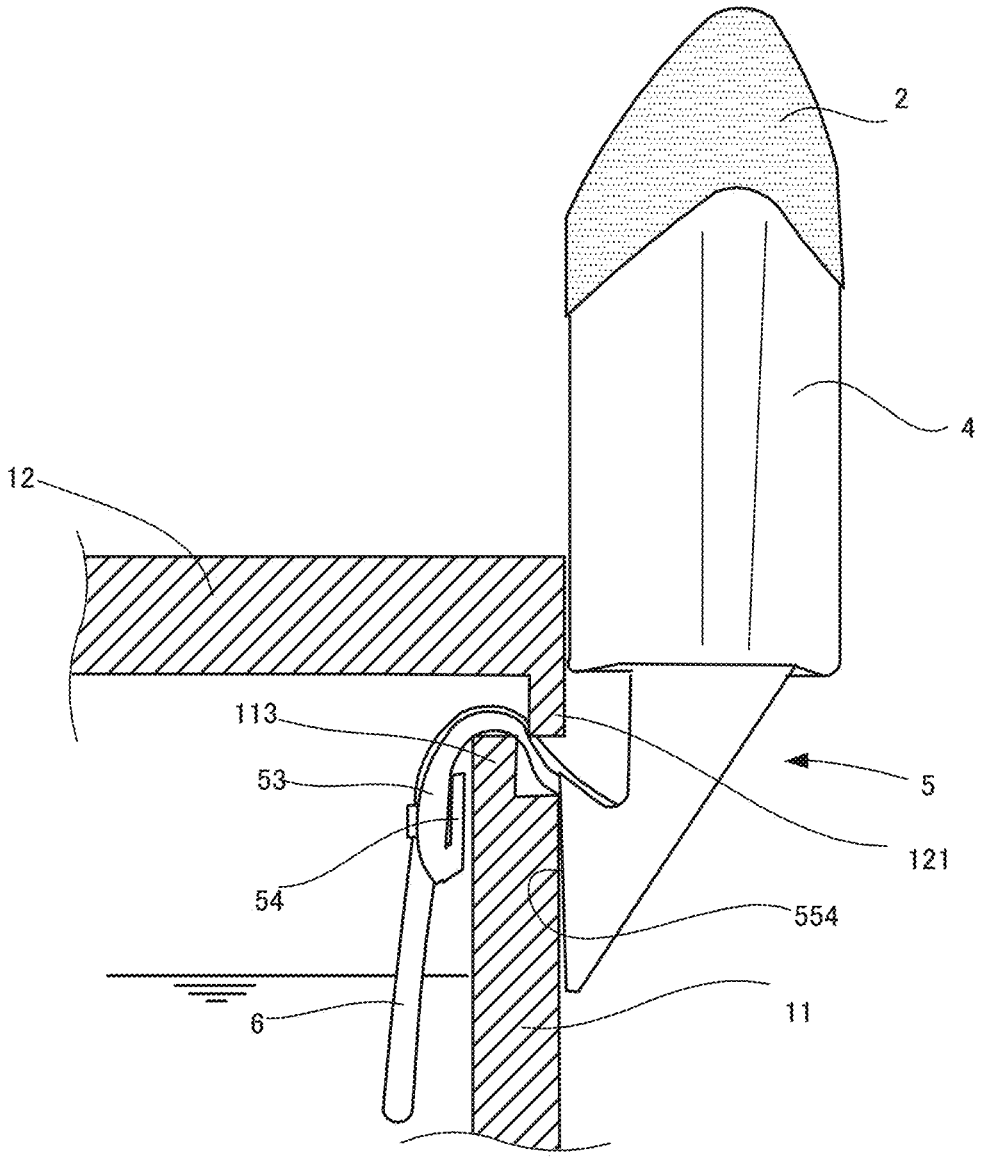
FIG. 22 is a side view showing attachment of the chemical feeding device to another water tank.

In the example of FIG. 22, the first edge portion 121 extends downward at the outer peripheral edge of the lid body 12. On the other hand, a protruding part 113 that protrudes upward is formed on the inner side of the upper end face of the edge 111 of the tank main body 11. The first edge portion 121 is disposed on the outer surface side of the protruding part 113 of the tank main body 11. In this case, again, since the fixing part 53 is disposed to straddle the edge 111 of the tank main body 11, the attachment member 5 is attachable.

In this way, the attachment member 5 according to the present embodiment can be attached to the water tank 1 over various modes.

Figure 23:
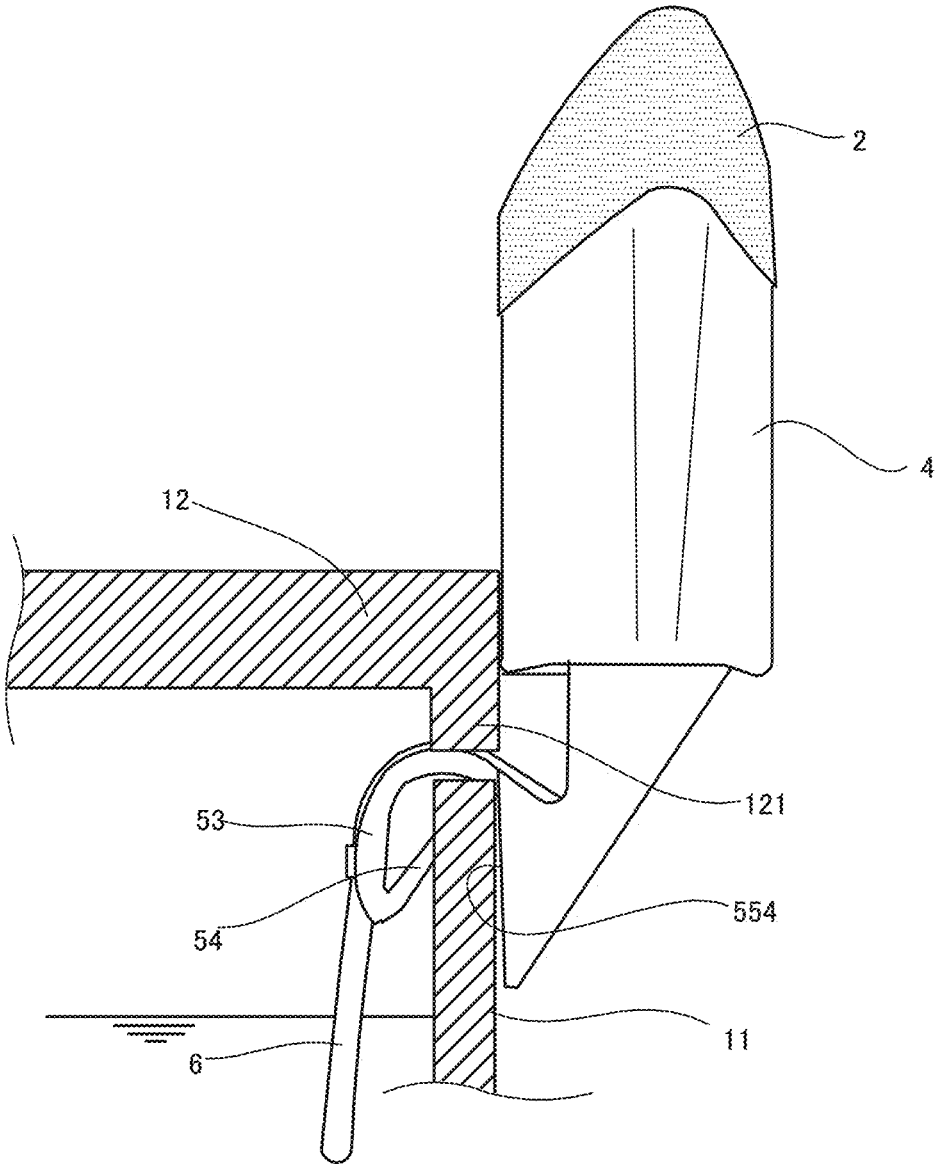
FIG. 23 is a side view showing another method of attaching the chemical feeding device to a water tank.

(4) In the above example, since the lid body 12 juts out from the tank main body 11, the receiving part 51 of the attachment member 5 is fitted into the support body 4, such that the second long wall part 411*b* of the support body 4 faces the fixing part 53 side of the attachment member 5. Interference between the support body 4 and the lid body 12 is thereby suppressed. On the other hand, in the case where the side surface of the lid body 12 is generally flush with the side of the tank main body 11 as shown in FIG. 23, the receiving part 51 of the attachment member 5 is fitted into the support body 4, such that the first long wall part 411*a* of the support body 4 faces the fixing part 53 side of the attachment member 5. Since the first long wall part 411*a* of the support body 4 thereby juts out more on the water tank 1 side than the first extension surface 551 of the attachment member 5, the support body 4 and the lid body 12 can be inhibited from being too far apart.

In this way, with the attachment member 5 and the support body 4 according to the present embodiment, the orientation of the support body 4 with respect to the attachment member 5 can be changed, according to whether or not the lid body 12 juts out. Accordingly, the support body 4 can be disposed to prevent interference between the lid body 12 and the support body 4 or to ensure that the distance between the lid body 12 and the support body 4 is not too great.

Figure 24:
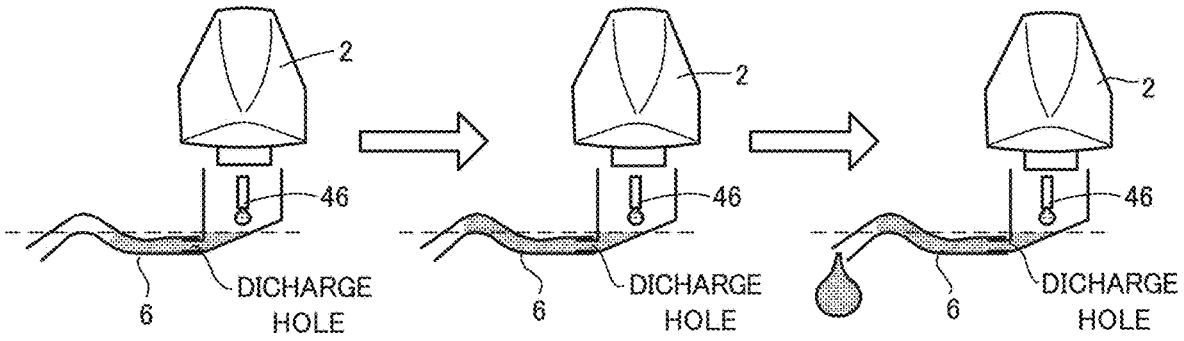
FIG. 24 is a side view showing feeding of a chemical solution in a chemical feeding device different from the present invention.

(5) Since the tube 6 is supported by the attachment member 5 to be located lower than the discharge hole in the receiving part, the following effects can be obtained. For example, as shown in FIG. 24, in the case where part of the tube is located higher than the discharge hole of the receiving part, the chemical solution that drips from the discharge hole will accumulate between the discharge hole and the portion of the tube located higher than the discharge hole, and thus there is a chance that the accumulated chemical solution will flow out all at once due to the siphon principal.

Figure 25:
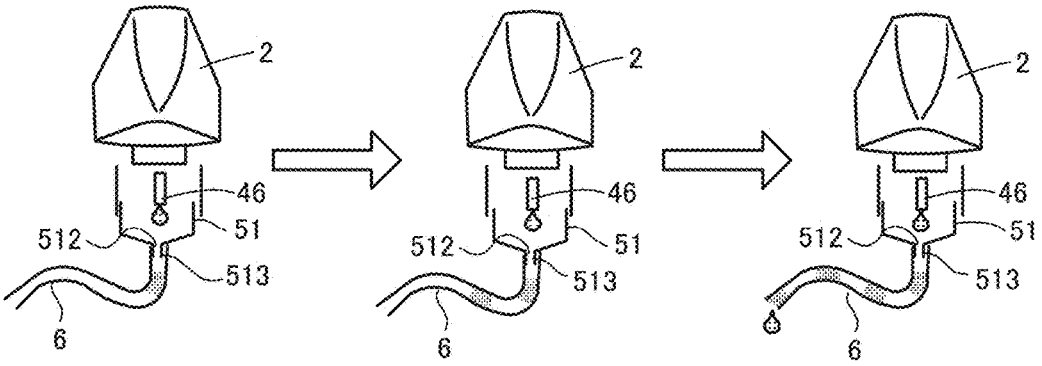
FIG. 25 is a side view showing feeding of a chemical solution in the chemical feeding device.

On the other hand, as shown in FIG. 25, if the tube 6 is located lower than the discharge hole 512 in the receiving part 51, the chemical solution that drips from the guide plate 46 into the receiving part 51 enters the tube 6 alternately with air, thus enabling the chemical solution to be fed from the tube 6 into the water tank 1 in small amounts.

(6) In the attachment member 5, the guiding member 557, the curved surface 552, the second extension surface 553 and the fixing part 53 on which the tube 6 is disposed are each formed by a curved surface or a flat surface, and thus do not have corners. Accordingly, the tube 6 can be prevented from being bent. As a result, since kinking of the tube 6 can be suppressed, the chemical solution is able to flow smoothly through the tube 6.

(7) The guide plate 46 faces the second long wall part 411*b* inside the casing 41 of the support body 4. Thus, the chemical solution that flows along the guide plate 46 is partially volatilized on the guide plate 46. Thus, since the scented component flows outside through the openings 413 in the casing, a scented effect can be obtained.

(8) The conical bottom surface of the recessed part 511 of the receiving part 51, rather than the discharge hole 512 in the receiving part 51, is disposed directly below the guide plate 46 of the support body 4. Accordingly, the chemical solution that flows along the guide plate 46 drips onto the conical bottom surface, and does not directly enter the discharge hole 512. Thus, since the chemical solution is partially volatilized on this bottom surface, a scented effect can be obtained.

(9) Even if the lid body 12 is installed on the attachment member 5 and presses on the tube 6, the tube 6 is housed in the groove at that location (installation part), and thus is not completely squashed. Accordingly, the chemical solution is able to flow smoothly through the tube 6. Also, since the attachment member 5 has flexibility, the groove decreases in diameter when pressed by the lid body 12. The inner wall surface of the groove and the tube 6 are thereby in intimate contact with each other, thus enabling the tube 6 to be firmly fixed in the groove.

7. Variations

One embodiment of the present invention is described above, but the present invention is not limited to the above embodiment, and various changes can be made without departing from the spirit of the invention. The following changes can be made, for example. Also, the gists of following variations can be combined as appropriate.

7-1: In the above embodiment, the chemical inducing member 3 and the support body 4 are provided, but as long as the chemical solution discharged from the chemical container 2 is fed to the water tank 1 by the tube 6, and the chemical container 2 is directly or indirectly supported in the water tank 1 by the attachment member 5, the structure between the chemical container 2 and the attachment member 5 is not particularly limited.

7-2: A configuration need only be adopted in which the attachment member includes the receiving part 51 in which the recessed part 511 for receiving the chemical solution that drips from the chemical container 2 is formed, and the tube 6 is connected to the discharge hole 512 formed in the bottom portion of the recessed part 511 and is supported by the attachment member 5 to be located lower than the discharge hole 512. Accordingly, in all other respects, the configuration of the receiving part 51 is not limited and can be changed as appropriate.

7-3: The configuration for attaching the attachment member 5 to the water tank 1 is not particularly limited, and the attachment member 5 need only be configured to at least be attached between the tank main body 11 and the lid body 12 of the water tank 1. Accordingly, the configuration of the fixing part 53 can be changed as appropriate, for example.

7-4: The tube 6 need only be attached at any position of the attachment member 5, and, unlike the above embodiment, need not be attached to follow the abutting part 52 and the fixing part 53. Accordingly, a groove is not necessarily required.

Figure 26:
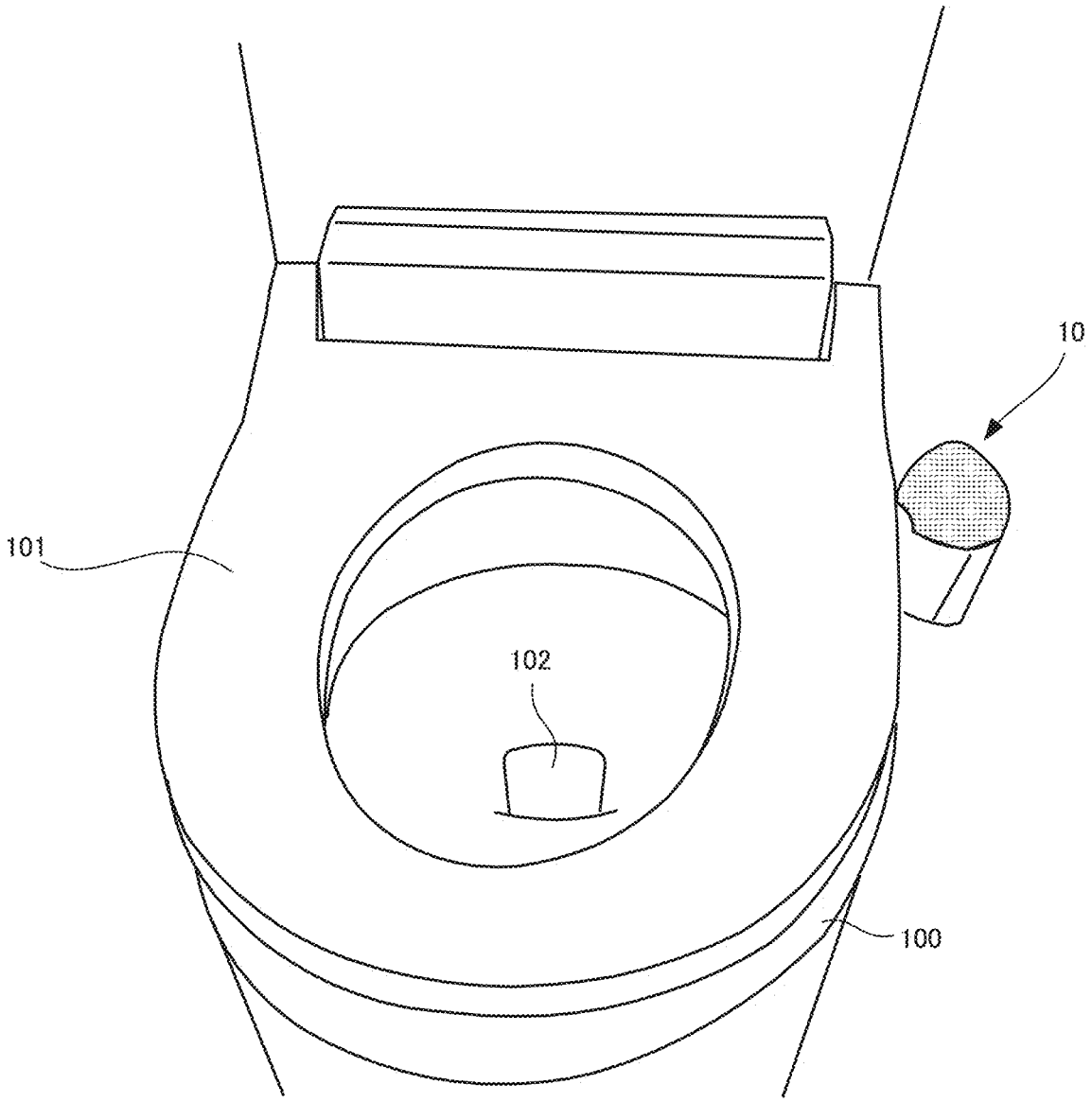
FIG. 26 is a perspective view in which the chemical feeding device is attached to the rim of a toilet bowl and a toilet seat is installed.
Figure 27:
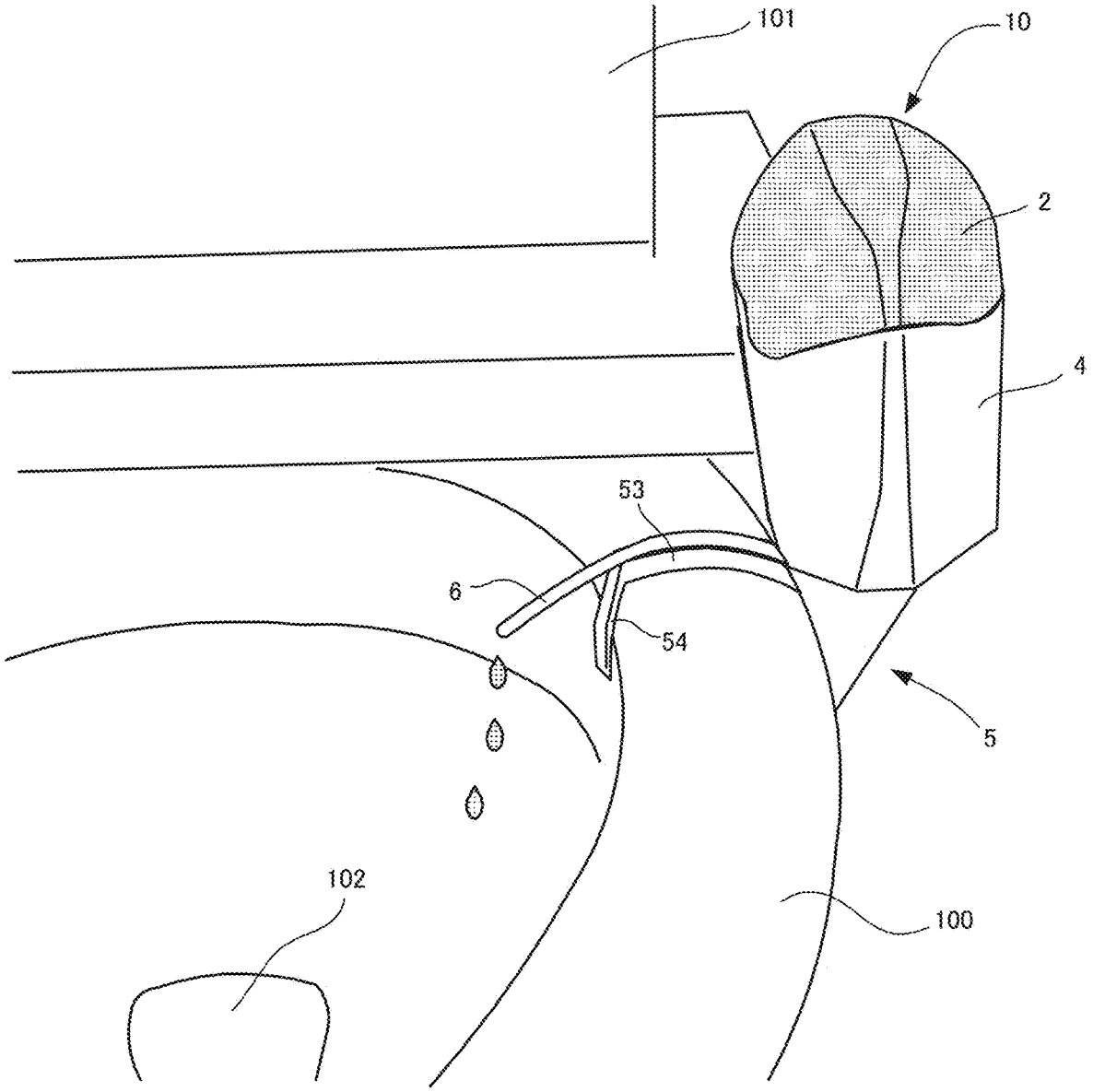
FIG. 27 is a perspective view showing a state in which the toilet seat is swiveled upward from the toilet bowl.
Figure 28:
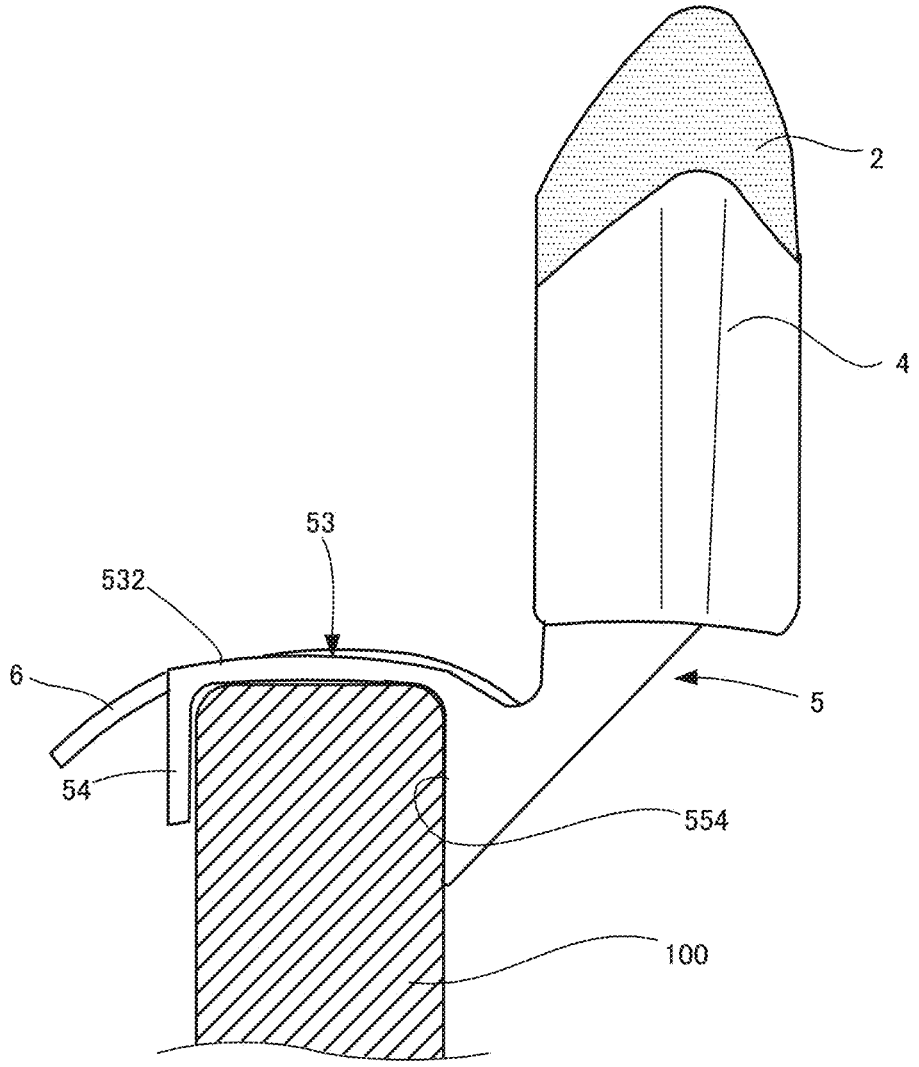
FIG. 28 is a cross-sectional view of the chemical feeding device attached to the toilet bowl.

7-5: In the above embodiment, an example in which the chemical feeding device is attached to the water tank is shown, but the chemical feeding device can also be attached to the toilet bowl. This variation will be described with reference to FIGS. 26 to 28. FIG. 26 is a perspective view in which the chemical feeding device is attached to the rim of the toilet bowl and a toilet seat is installed, FIG. 27 is a perspective view showing a state in which the toilet seat is swiveled upward from the toilet bowl, and FIG. 28 is a cross-sectional view of the chemical feeding device attached to the toilet bowl.

The chemical feeding device 10 can be attached with the method shown in FIGS. 13 to 17 described above, according to the width of the rim of the toilet bowl 100, but considering the width of the rim of a typical toilet bowl 100, the chemical feeding device 10 can be attached in a similar manner to FIG. 16. That is, as shown in FIG. 28, the curved fixing part 53 is extended linearly, and the angle between the folded part 54 and the extension part 532 is further widened to generally 90 degrees. The rim of the toilet bowl 100 can thereby be sandwiched between the abutting surface 554 and the folded part 54. When the toilet seat 101 is installed on the toilet bowl 100, the chemical feeding device 10 will be in the state shown in FIG. 26. In this way, the container 2 and the support body 4 of the chemical feeding device 10 are attached on the outer side of the rim of the toilet bowl 100, and thus there is no interference even when the toilet seat 101 is installed.

The chemical solution that is fed from the container 2 is fed from the tube 6 into the toilet bowl 100, and adheres to the inner wall surface of the toilet bowl 6 or is fed to sealing water 102. Then, when water flows into the toilet bowl 100 (e.g., flush switch is turned on), the water flows together with the chemical solution along the inner wall surface of the toilet bowl 100, and the inner wall surface is cleaned. Also, waste matter tends not to adhere, due to the chemical solution being fed to the inner wall surface of the toilet bowl 100.

In this way, the chemical feeding device of the Present invention can be attached to both the water tank 1 and the toilet bowl 100, and thus an installation location is easily secured. Also, the chemical solution can be fed to the water tank 1 or into the toilet bowl 100 in a stable manner.

LIST OF REFERENCE NUMERALS

1 Water tank
11 Tank main body
12 Lid body
2 Container
5 Attachment member
51 Receiving part
52 Abutting part
554 Abutting surface
53 Fixing part
54 Folded part
6 Tube

What is claimed is:

1. A chemical feeding device for attaching to a bowl of a toilet, comprising:

a chemical container storing a chemical solution;

a flexible tube through which the chemical solution in the chemical container is fed to an inside of the toilet bowl; and an attachment member that supports the tube and is configured to be attachable to a rim of the toilet bowl, wherein the attachment member includes a receiving part in which a recessed part for receiving the chemical solution that drips from the chemical container is formed, in a bottom portion of the recessed part is formed a discharge hole to which the tube is connected, and the tube is supported to be located lower than the discharge hole by the attachment member.

2. The chemical feeding device according to claim 1, wherein the attachment member includes:

an abutting part capable of abutting an outer surface of the rim of the toilet bowl; and a fixing part that, in an initial state, straddles the rim of the toilet bowl from the abutting part and extends downward along an inner wall surface of the toilet bowl.

3. The chemical feeding device according to claim 2, wherein the fixing part is formed with a flexible material and, in the initial state, curves upward in a convex shape.

4. A chemical feeding device for attaching to a water tank of a toilet having a tank main body that has an opening in an upper portion and a lid body that covers the opening of the tank main body, comprising:

a chemical container storing a chemical solution;

a flexible tube through which the chemical solution in the chemical container is fed to the water tank; and an attachment member that supports the tube and is configured to be attachable to an edge of the upper opening of the tank main body, wherein the attachment member includes a receiving part in which a recessed part for receiving the chemical solution that drips from the chemical container is formed, in a bottom portion of the recessed part is formed a discharge hole to which the tube is connected, and the tube is supported to be located lower than the discharge hole by the attachment member.

5. The chemical feeding device according to claim 4, wherein the attachment member includes:

an abutting part capable of abutting an outer surface of the tank main body; and a fixing part that, in an initial state, straddles the edge of the tank main body from the abutting part and extends downward along an inner surface of the tank main body.

6. The chemical feeding device according to claim 5, wherein the fixing part is formed with a flexible material and, in the initial state, curves upward in a convex shape.

7. The chemical feeding device according to claim 5, wherein at an upper portion of the abutting part is formed an installation surface on which an edge extending downward from an outer peripheral edge of the lid body is installable.

* * * * *